US011130616B2

(12) United States Patent
Resh et al.

(10) Patent No.: US 11,130,616 B2
(45) Date of Patent: Sep. 28, 2021

(54) APPARATUS FOR CLOSING A CONTAINER

(71) Applicant: The Hillshire Brands Company, Chicago, IL (US)

(72) Inventors: Mary Lou Resh, Chicago, IL (US); Jeffrey Anthony Czarny, Chicago, IL (US)

(73) Assignee: The Hillshire Brands Company, Chicago, IL (US)

( * ) Notice: Subject to any disclaimer, the term of this patent is extended or adjusted under 35 U.S.C. 154(b) by 0 days.

(21) Appl. No.: 16/094,310

(22) PCT Filed: Oct. 16, 2018

(86) PCT No.: PCT/US2018/056122
§ 371 (c)(1),
(2) Date: Oct. 17, 2018

(87) PCT Pub. No.: WO2019/079328
PCT Pub. Date: Apr. 25, 2019

(65) Prior Publication Data

US 2021/0070504 A1 Mar. 11, 2021

Related U.S. Application Data

(60) Provisional application No. 62/574,354, filed on Oct. 19, 2017.

(51) Int. Cl.
*B65D 33/24* (2006.01)
*B65D 33/16* (2006.01)

(52) U.S. Cl.
CPC ..... *B65D 33/24* (2013.01); *B65D 33/165* (2013.01); *B65D 33/1691* (2013.01); *B65D 2313/02* (2013.01); *B65D 2581/3494* (2013.01)

(58) Field of Classification Search
CPC ..... B65D 33/24; B65D 33/28; B65D 33/30; B65D 33/165; B65D 33/1691; B65D 2313/02; B65D 2581/3494
USPC ..... 383/62, 71, 89
See application file for complete search history.

(56) References Cited

U.S. PATENT DOCUMENTS

| | | | | |
|---|---|---|---|---|
| 424,411 | A | 3/1890 | Fielder | |
| 5,135,125 | A * | 8/1992 | Andel | A61M 5/1417 215/12.1 |
| 5,489,766 | A | 2/1996 | Walters | |
| 5,829,788 | A * | 11/1998 | Jackson | B65D 23/005 283/81 |
| 2006/0280386 | A1 | 12/2006 | Bublitz | |
| 2007/0036472 | A1 | 2/2007 | Persenda | |
| 2010/0158414 | A1 | 6/2010 | Michailidis | |
| 2013/0270275 | A1 | 10/2013 | Abrams | |
| 2015/0239615 | A1* | 8/2015 | O'Donnell | B65D 23/14 428/41.8 |
| 2019/0291925 | A1* | 9/2019 | Milbrandt | B65D 71/063 |

* cited by examiner

*Primary Examiner* — Jes F Pascua
(74) *Attorney, Agent, or Firm* — Duane Morris LLP

(57) ABSTRACT

Various embodiments of the present disclosure provide an apparatus attachable to a container and usable to secure the container closed. The apparatus is transitionable from a nonuse configuration to a use configuration to form an (at least partially) elastic loop attached to the container and usable to circumscribe the container to secure the container closed.

20 Claims, 15 Drawing Sheets

APPARATUS FOR CLOSING A CONTAINER

CROSS-REFERENCE

This application is a U.S. national stage application under § 371 of International Patent Application No. PCT/US18/56122, entitled "APPARATUS FOR CLOSING A CONTAINER" filed Oct. 16, 2018, which claims priority under 35 U.S.C. § 119(e) from U.S. Provisional App. Ser. No. 62/574,354 entitled "APPARATUS FOR SECURING A CONTAINER CLOSED" filed Oct. 19, 2017 which is hereby incorporated by reference herein in its entirety.

FIELD

This patent application relates to apparatuses usable to secure containers closed. More specifically, this patent application relates to apparatuses attachable to containers and including elastomeric components usable to secure the containers closed.

BACKGROUND

Deformable containers like plastic bags are used to package loose product such as food (like candy, potato chips, or chicken fingers); hardware (like nuts and bolts); seeds; or other bulk items. A consumer who purchases loose product in one of these deformable containers usually doesn't use all of the product at once. Instead, the consumer uses some of the product, leaves the rest in the container, and uses some apparatus (such as a spring-loaded plastic clip) to re-close the container. For instance, if the consumer buys a bag of food product and doesn't consume it all in one sitting, the consumer typically uses some apparatus to re-close the bag to keep the food product fresh and reduce the possibility of contamination.

SUMMARY

Various embodiments of the present disclosure provide an apparatus attachable to a container and usable to secure the container closed. The apparatus is transitionable from a nonuse configuration to a use configuration to form an (at least partially) elastic loop attached to the container and usable to circumscribe the container to secure the container closed.

DETAILED DESCRIPTION

FIGS. 1A-2D illustrate one example embodiment of the container closing apparatus 10 of the present disclosure attached to and usable to secure a deformable container C closed. The container closing apparatus 10 is transitionable from a nonuse configuration to a use configuration to form an (at least partially) elastic loop attached to the container C and usable to circumscribe an upper end and a lower end of the container C to secure the container C closed.

Figure 1A:
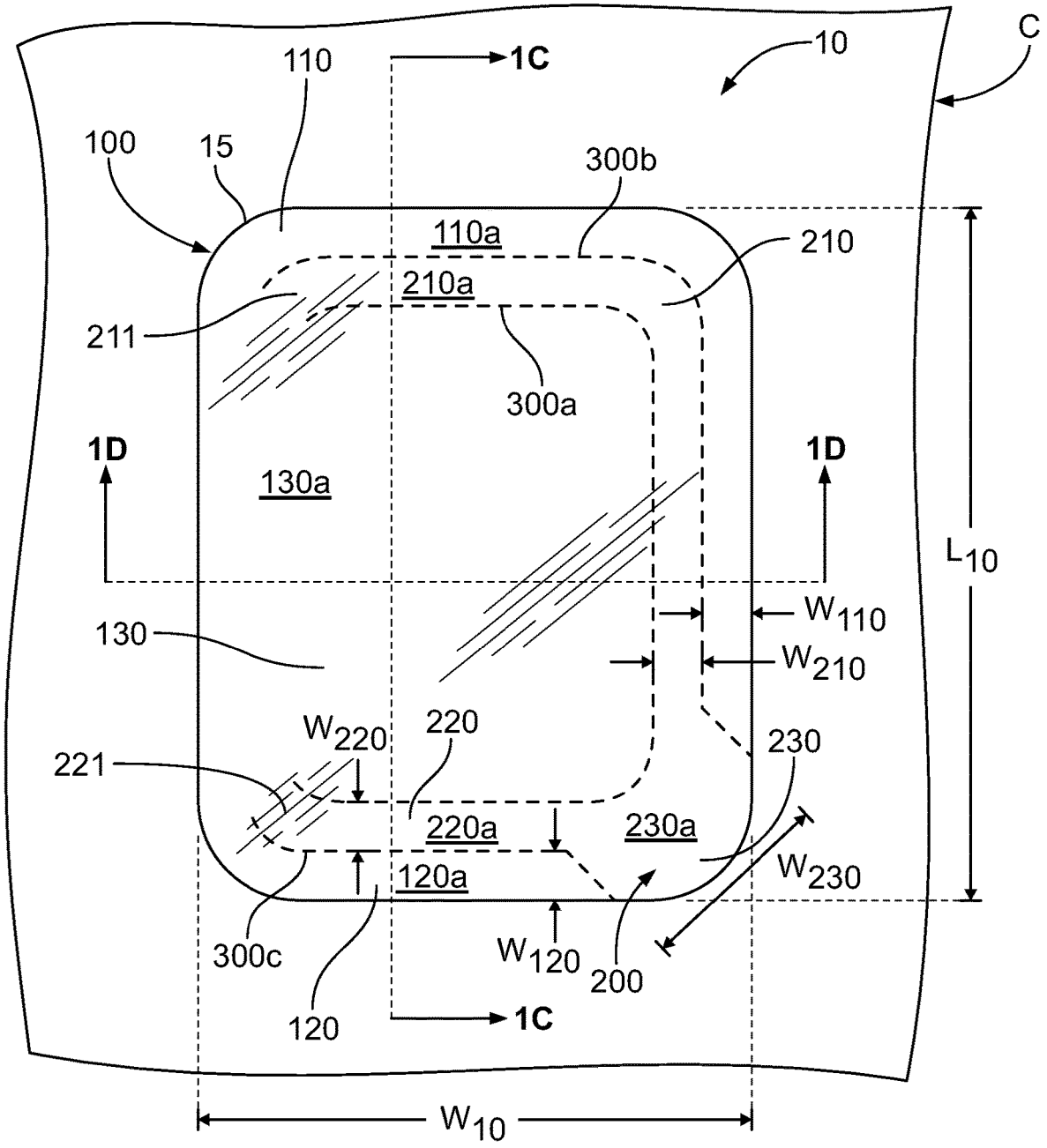
FIG. 1A is a top plan view of one embodiment of the container closing apparatus of the present disclosure attached to a container and in a nonuse configuration.
Figure 2B:
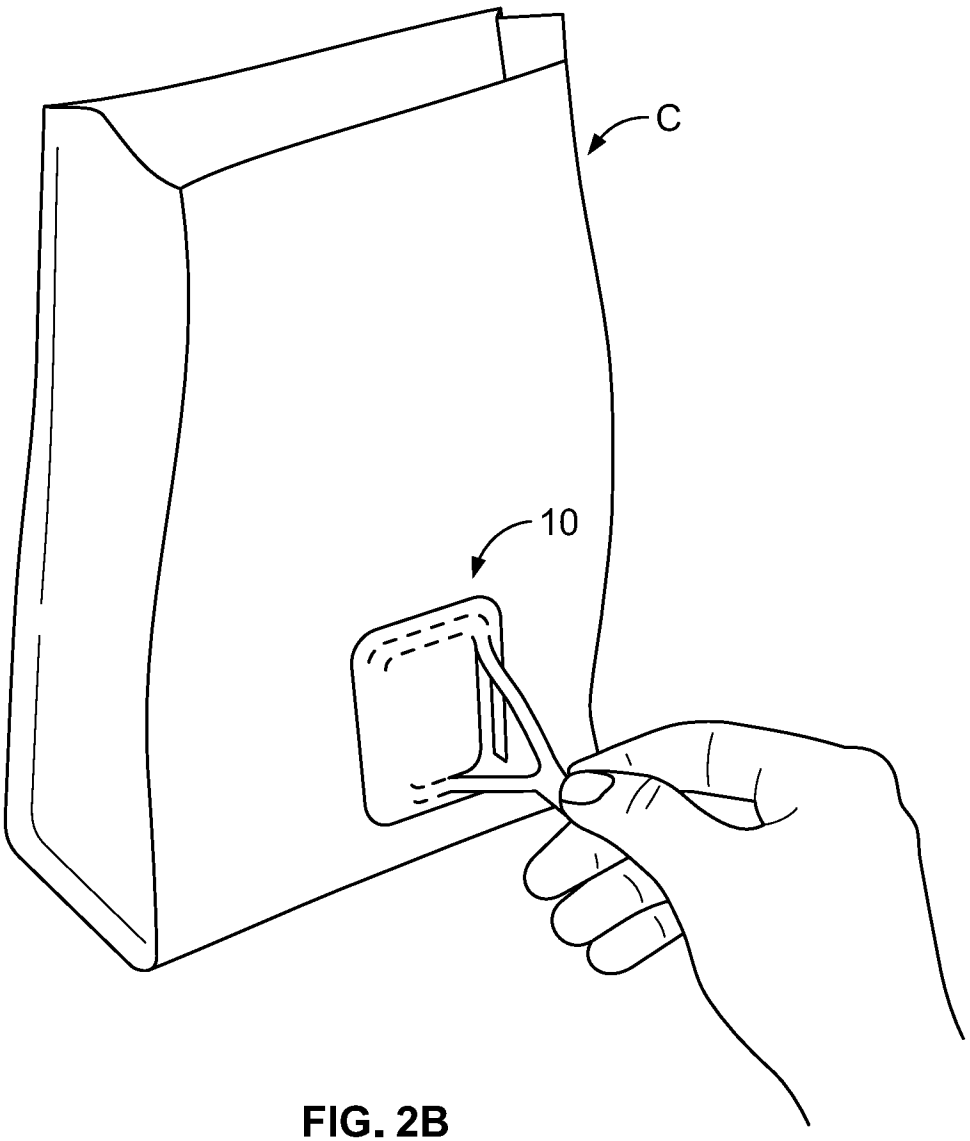
FIG. 2B is a perspective view of the container of FIG. 2A after the user has partially detached the detachable portion of the elastic member of the container closing apparatus from the base of the container closing apparatus to begin transitioning the container closing apparatus from the nonuse configuration to the use configuration.

The container closing apparatus 10 includes a base 100 and an elastic member 200. The elastic member 200 includes an attached portion that is attached to the base 100 at certain areas and a detachable portion that is removably attached to the base 100 along perforations 300*a*, 300*b*, and 300*c* defined through the container closing apparatus 10. The perforations 300*a*, 300*b*, and 300*c* enable the detachable portion of the elastic member 200 to be detached from the base 100 (in this embodiment, permanently detached) while the attached portion of the elastic member 200 remains attached to the base 100. The perforations 300*a*, 300*b*, and 300*c* thus render the container closing apparatus 10 transitionable from (1) a nonuse configuration in which the detachable portion of the elastic member 200 is still removably attached to the base 100 along the perforations 300*a*, 300*b*, and 300*c* (as best shown in FIG. 1A) to (2) a use configuration in which the detachable portion of the elastic member 200 is (in this embodiment, permanently) detached from the base 100 along the perforations 300*a*, 300*b*, and 300*c* while the attached portion of the elastic member 200 remains attached to the base 100 (as best shown in FIG. 2D). When the container closing apparatus 10 is in the use configuration, the elastic member 200 and part of the base 100 form an (at least partially) elastic loop usable to circumscribe the open upper end and the sealed lower end of the container C to secure the container C closed.

Figure 1B:
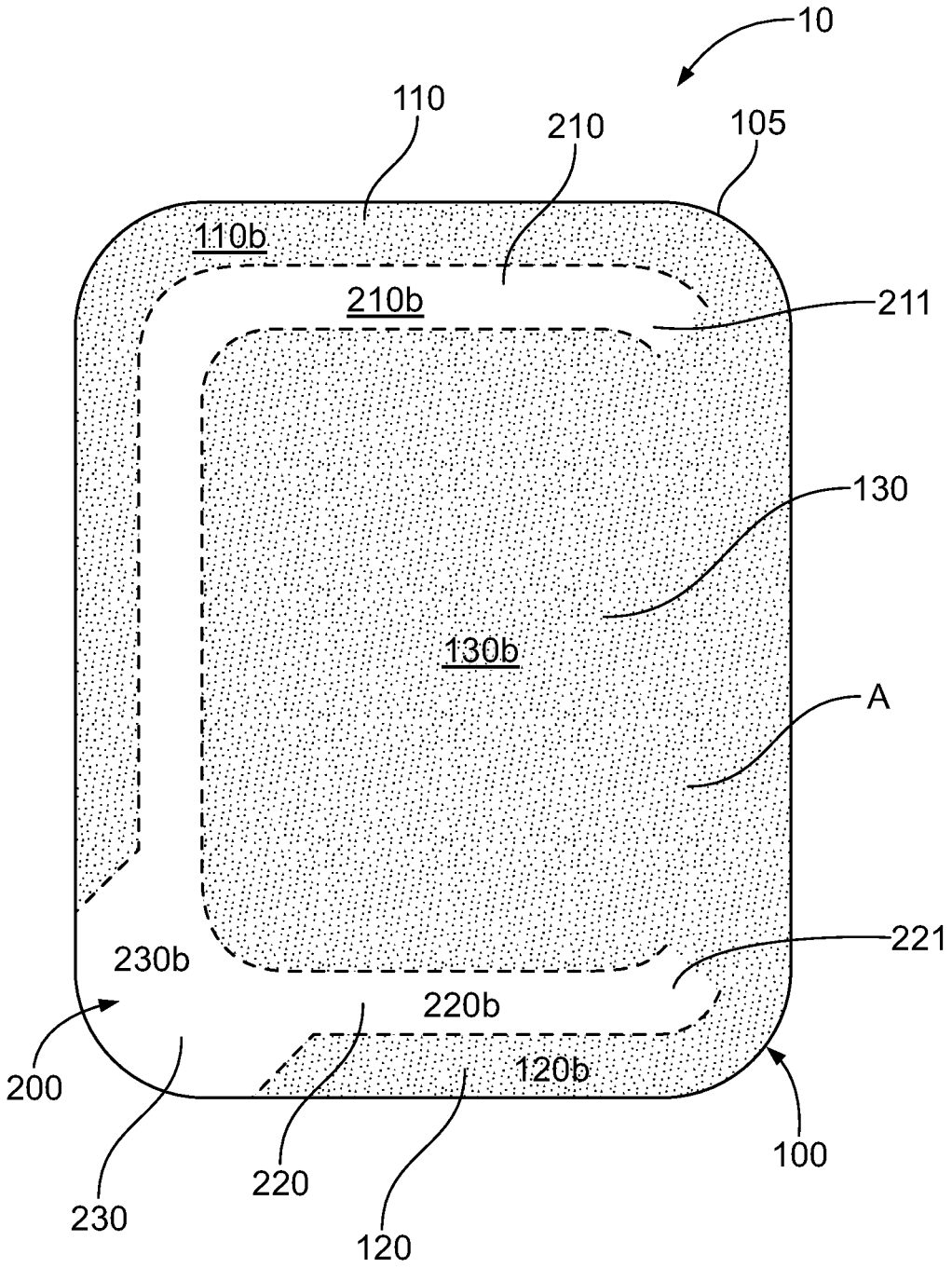
FIG. 1B is a bottom plan view of the container closing apparatus of FIG. 1A removed from the container.

As best shown in FIGS. 1A and 1B, when in the nonuse configuration, the container closing apparatus 10 has a generally rectangular shape with curved corners and includes a perimeter surface 15. The container closing apparatus may have any other suitable shape in other embodiments, such as a round shape, an oblong shape, or an oval shape. Different shapes allow for different shapes and sizes of the elastic member (described below), and can vary with the size, shape, and fill of the container. The container closing apparatus 10 in the nonuse configuration has a length $L_{10}$, a width $W_{10}$, and a thickness t, which may be any suitable values. The container closing apparatus 10 is formed from an elastomeric material, such as rubber or a suitable thermoplastic elastomer. In this embodiment, the material is transparent, which enables a user to see through the container closing apparatus 10 and view any printing on the portion of the container C to which the container closing apparatus 10 is attached. In other embodiments, the material is translucent. In other embodiments, the material is opaque, which enables advertisements, coupons, or any other suitable text or graphics to be printed on all or some of the container closing apparatus 10.

Perforations 300*a*, 300*b*, and 300*c* defined through the container closing apparatus 10 enable the detachable portion of the elastic member 200 to be permanently detached from the base 100. The perforations 300*a*, 300*b*, and 300*c* may be any suitable type (or types) of perforation(s), such as scores, perf-scores, or heavy-nics.

The base 100 includes a first outer base portion 110, a second outer base portion 120, and an inner base portion 130. The first outer base portion 110 is attached to—and here integrally formed with—the inner base portion 130. Similarly, the second outer base portion 120 is attached to—and here integrally formed with—the inner base portion 130. In other words, in this embodiment, the base 100 is unitary in that its components are integrally formed with one another.

The first outer base portion 110 has a generally constant width $W_{110}$, which may be any suitable value. The second outer base portion 120 has a generally constant width $W_{120}$, which may be any suitable value. In this embodiment, $W_{110}$ and $W_{120}$ are equal, though they may differ in other embodiments. The first and second outer base portions 110 and 120 and the inner base portion 130 have respective upper surfaces 110*a*, 120*a*, and 130*a* and respective lower surfaces 110*b*, 120*b*, and 130*b*.

The elastic member 200 includes a first elastic member portion 210, a second elastic member portion 220, and a grip portion 230. The first elastic member portion 210 is attached to—and here integrally formed with—the grip portion 230. Similarly, the second elastic member portion 220 is attached to—and here integrally formed with, the grip portion 230. In other words, in this embodiment, the elastic member 200 is unitary in that its components are integrally formed with one another.

The elastic member 200 generally forms a U shape, though in other embodiments the elastic member may have any suitable shape, such as a V shape, a semicircular shape, or a rounded rectangle. The first elastic member portion 210 has a generally constant width $W_{210}$, which may be any suitable value. The second elastic member portion 220 has a generally constant width $W_{220}$, which may be any suitable value. In this embodiment, $W_{210}$ and $W_{220}$ are equal, though they may differ in other embodiments. Grip portion 230 has a width $W_{230}$, which may be any suitable value. In this embodiment, $W_{230}$ is greater than $W_{210}$ and $W_{220}$, though $W_{230}$ may be less than or equal to $W_{210}$ and/or $W_{220}$ in other embodiments. The first and second elastic member portions 210 and 220 and the grip portion 230 have respective upper surfaces 210*a*, 220*a*, and 230*a* and respective lower surfaces 210*b*, 220*b*, and 230*b*.

The first elastic member portion 210 is attached to—and here integrally formed with—the base 100, and particularly the inner base portion 130, at one end 211. Similarly, the second elastic member portion 220 is attached to—and here integrally formed with—the base 100, and particularly the inner base portion 130, at one end 221. These ends 211 and 221 form the attached portion of the elastic member 200, while the remainder of the elastic member 200 is the detachable portion.

When the container closing apparatus 10 is in the nonuse configuration: (1) the first elastic member portion 210 is removably attached to the first outer base portion 110 via the perforation 300*b* and to the inner base portion 130 via the perforation 300*a*; (2) the second elastic member portion 220 is removably attached to the second outer base portion 210 via the perforation 300*c* and to the inner base portion 130 via the perforation 300*a*; and (3) the grip portion 230 is removably attached to the first outer base portion 110 via the perforation 300*b*, to the second outer base portion 220 via the perforation 300*c*, and to the inner base portion 130 via the perforation 300*a*. The first elastic member portion 210 is bordered on one side by the first outer base portion 110 and on the other side by the inner base portion 130. That is, in this embodiment, the first elastic member portion 210 does not include any of the perimeter surface 15. The second elastic member portion 220 is bordered on one side by the second outer base portion 120 and on the other side by the inner base portion 130. That is, in this embodiment, the second elastic member portion 210 does not include any of the perimeter surface 15. The grip portion 230 forms one of the corners of the container closing apparatus 10, and is bordered on one side by the inner base portion 130. The grip portion 230 separates—and is therefore bordered on two sides by—the first and second outer base portions 110 and 120 in the direction of $W_{230}$. The grip portion 230 includes part of the perimeter surface 15. Thus, in this embodiment, the elastic member 200 aside from part of the grip portion 230 is offset radially inward from the perimeter edge 15.

In other embodiments, first and/or second elastic member portions include part of the perimeter surface. For instance, in some embodiments, the base does not include the first outer base portion and/or the second outer base portion. In these embodiments, the first and second elastic member portions are removably attached to the inner base portion but not to any outer base portion radially outward of the first and second elastic member portions.

When the container closing apparatus 10 is in the use configuration: (1) the first elastic member portion 210 is permanently detached from the first outer base portion 110 and from the inner base portion 130 via the perforation 300*a*; (2) the second elastic member portion 220 is permanently detached from the second outer base portion 210 via the perforation 300*c* and from the inner base portion 130 via the perforation 300*a*; and (3) the grip portion 230 is permanently detached from the first outer base portion 110 via the perforation 300*b*, from the second outer base portion 220 via the perforation 300*c*, and from the inner base portion 130 via the perforation 300*a*. That is, when the container closing apparatus 10 is in the use configuration in this embodiment, the elastic member 200 is attached to the base 100 only at the ends 211 and 221 of the first and second elastic member portions 210 and 220, respectively (i.e., via the attached portion of the elastic member 200). Additionally, once the container closing apparatus 10 has transitioned from the nonuse configuration to the use configuration, the container closing apparatus 10 cannot transition back to the nonuse configuration. In other words, the transition is permanent in this embodiment.

Figure 1C:
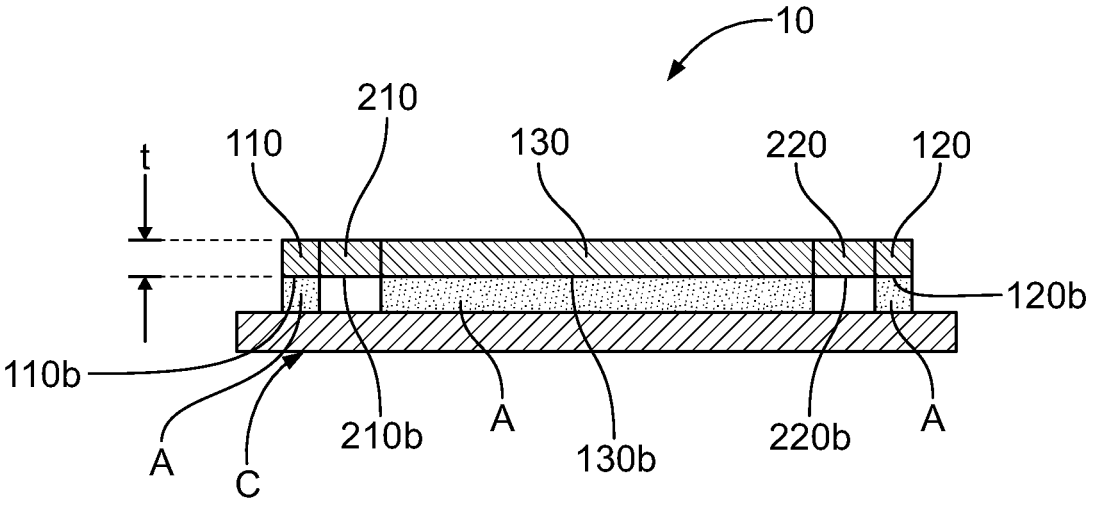
FIG. 1C is a cross-sectional side elevational view of the container closing apparatus of FIG. 1A taken substantially along the line 1C-1C of FIG. 1A.
Figure 1D:
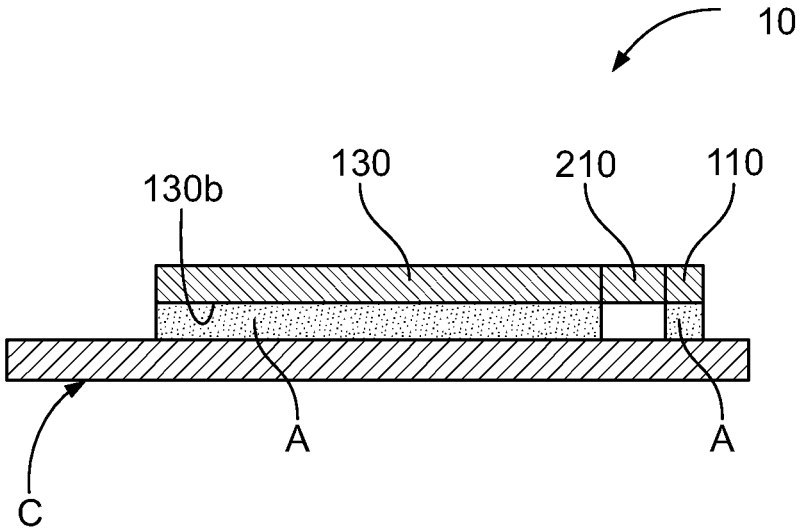
FIG. 1D is a cross-sectional side elevational view of the container closing apparatus of FIG. 1A taken substantially along the line 1D-1D of FIG. 1A.

As best shown in FIGS. 1B-1D, the container closing apparatus 10 is attached to the container C via an adhesive A disposed between the lower surface of the base 100 and the container C. More specifically, the adhesive A is disposed between container C and the lower surfaces 110*b*, 120*b*, and 130*b* of the first and second outer base portions 110 and 120 and the inner base portion 130, respectively, of the base 100. In this embodiment, the adhesive A is not disposed between the lower surfaces of the elastic member 200 (i.e., the lower surfaces 210*a*, 210*b*, and 210*c* of the first elastic member portion 210, the second elastic member portion 220, and the grip portion 230) and the container C. Put differently, the base 100 is directly attached to the container C via the adhesive A and the elastic member 200 is indirectly attached to the container C via the attachment of the elastic member 200 to the base 100. As described below, this facilitates detachment of the detachable portion of the elastic member 200 from the base 100.

The adhesive A may be any suitable permanent or removable adhesive, such as pressure-sensitive adhesives, epoxy adhesives, or polyurethane adhesives. The adhesive may be cured in various embodiments in any suitable manner, such as via ultraviolet light or heat. In other embodiments, instead of or in addition to using an adhesive, the container closing apparatus may be attached to the container via a suitable welding process, a sonic sealing process, or a heat sealing process. In this embodiment, the adhesive is transparent (but in other embodiments the adhesive may be translucent or opaque). Other manners of attachment may be used to attach the container closing apparatus 10 to the container C, such as tape.

The drawings are not to scale, and the thickness of the base, the elastic member, and the adhesive are exaggerated for clarity.

In one embodiment, the container closing apparatus 10 is manufactured by: cutting a piece of elastomeric material from a sheet of elastomeric material in a suitable manner (such as via a die cutting system) to form the perimeter surface 15; perforating the piece of elastomeric material in a suitable manner (such as via a perforating or scoring system) to form the perforations 300*a* 300*b*, and 300*c*; applying the adhesive A to the lower surfaces 110*b*, 120*b*, and 130*b* of the first and second outer base portions 110 and 120 and the inner base portion 130, respectively (such as via an adhesive spraying or rolling system); and applying a release liner to the exposed adhesive A. During manufacture, the adhesive A is not applied to the lower surfaces of the elastic member 200.

In various embodiments, a method of manufacturing the container C comprises: removing the release liner from the adhesive A; attaching the container closing apparatus 10 to the container C by contacting the container C with the adhesive A; filling the container C with goods; and sealing the container C closed. In some embodiments, multiple container closing apparatuses 10 are disposed on a single release liner and formed into a roll. In these embodiments, a suitable applicator (such as a label applicator or modified label applicator) is used to sequentially apply the container closing apparatuses 10 from the roll onto containers C moving along a manufacturing line. In other embodiments, the container closing apparatus is attached to flat roll stock film that is later be formed into the container C. In further embodiments, release liners are not used, and the container closing apparatus is seamlessly printed and then applied to the container C. The container closing apparatus may be attached to the container C at any suitable point in the manufacturing process, including before the container C is formed, after the container C is formed and before it is filled with product, or after the container C is formed and after it is filled with product.

FIGS. 2A-2D illustrate one example embodiment of a user transitioning the container closing apparatus 10 of the present disclosure from the nonuse configuration to the use configuration and using the container closing apparatus 10 to secure the container C closed.

Figure 2A:
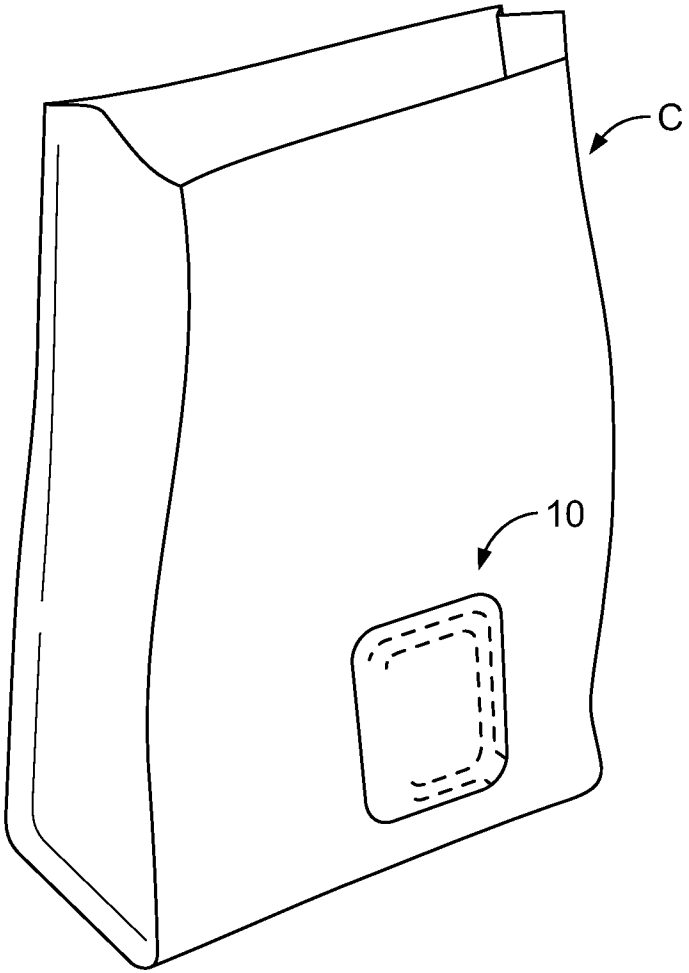
FIG. 2A is a perspective view of a deformable container that has an open upper end and a sealed lower end and to which the container closing apparatus of FIG. 1A is attached. The container closing apparatus is in the nonuse configuration.
Figure 2D:
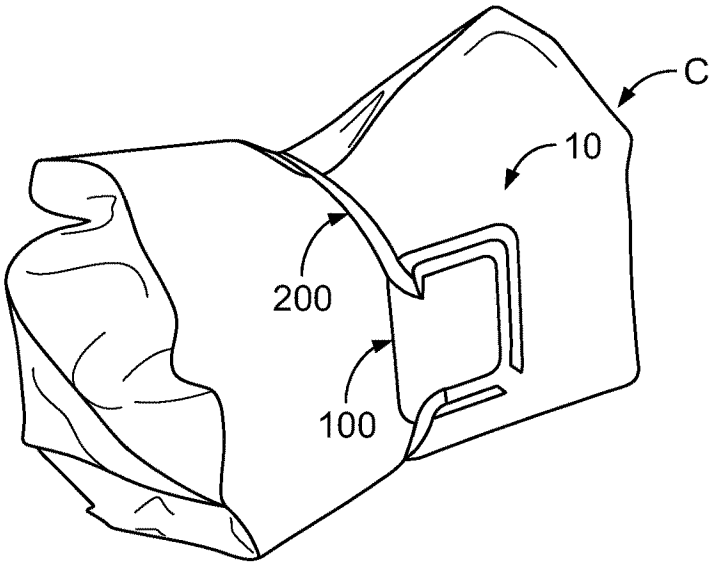
FIG. 2D is a perspective view of the container of FIG. 2A after the user has deformed the container and secured it closed by circumscribing the container with a loop formed by the base and the elastic member of the container closing apparatus (which is in the use configuration).

As shown in FIG. 2A, the container C's upper end is open, and the container closing apparatus 10 is initially in the nonuse configuration (described above). To begin transitioning the container closing apparatus 10 from the nonuse configuration to the use configuration, a user grips the grip portion 230 and imposes a pulling force on the grip portion 230 in a direction away from the base 100. Assuming the user applies a large enough pulling force on the grip portion 230, the grip portion 230 detaches from the first and second outer base portions 110 and 120 along the perforations 300*b* and 300*c*, respectively, and from the inner base portion 130 along the perforation 300*a*. As the user continues to apply the pulling force on the grip portion 230, the first and second elastic member portions 210 and 220 begin detaching from the first and second outer base portions 110 and 120 along the perforations 300*b* and 300*c*, respectively, and from the inner base portion 130 along the perforation 300*a*. FIG. 2B shows the container closing apparatus 10 after the user has partially detached the detachable portion of the elastic member 200 from the base 100 to begin transitioning the container closing apparatus 10 from the nonuse configuration to the use configuration.

Figure 2C:
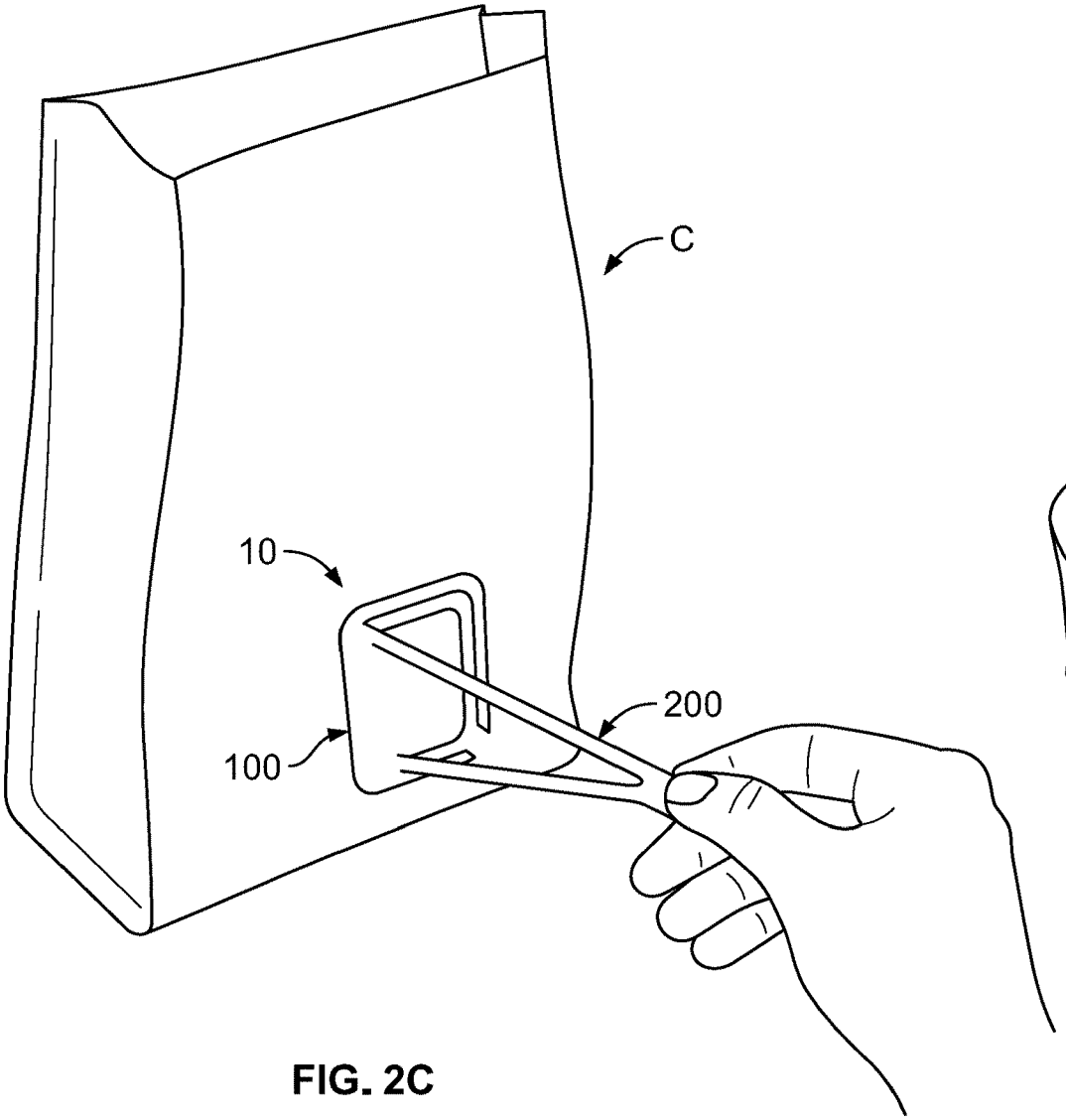
FIG. 2C is a perspective view of the container of FIG. 2A after the user has completely detached the detachable portion of the elastic member of the container closing apparatus from the base of the container closing apparatus such that the container closing apparatus is in the use configuration.

The user ceases to apply the pulling force on the grip portion 230 once the detachable portion of the elastic member 200 has completely detached from the base 100 (i.e., once the first and second elastic member portions 210 and 220 and the grip portion 230 have detached from the first and second outer base portions 110 and 120 and the inner base portion 130 along the perforations 300*a*, 300*b*, and 300*c*). At this point, as shown in FIG. 2C, the elastic member 200 and part of the base 100 form a loop since the elastic member 200 is still attached to the base 100 at the ends 211 and 221 of the first and second elastic member portions 210 and 220, respectively. The elastic member 200 has a normal shape—here, a U shape (though it may take any suitable shape as indicated above). The properties of the elastic material from which the elastic member 200 is made render the elastic member 200 deformable (e.g., flexible and stretchable) yet biased to return to its normal shape.

When the user desires to close the container C, the user pinches the open end closed and rolls the open end toward the sealed lower end to force much of the air out of the container C. Afterwards, the user stretches the elastic member 200 radially outward and circumscribes the container C with the loop formed by the base and the elastic member 200. The user then releases the elastic member 200. Since the elastic member 200 is stretched at the point in time at which the user releases the elastic member 200, the elastic member 200 attempts to return to its normal shape. In doing so, the elastic member 200 contracts radially inward until it contacts the container C and applies a compressive force to the container C along the circumference of the loop. FIG. 2D shows the container C secured closed via the loop of the container closing apparatus.

FIGS. 3A-4D illustrate another example embodiment of the container closing apparatus 1000 of the present disclosure attached to and usable to secure a deformable container C closed. The container closing apparatus 1000 is transitionable from a nonuse configuration to a use configuration to form an (at least partially) elastic loop attached to the container C and usable to circumscribe an upper end and a lower end of the container C to secure the container C closed.

The container closing apparatus 1000 includes a base 1100, an elastic member 1200, and a protective layer 1300.

Figure 3A:
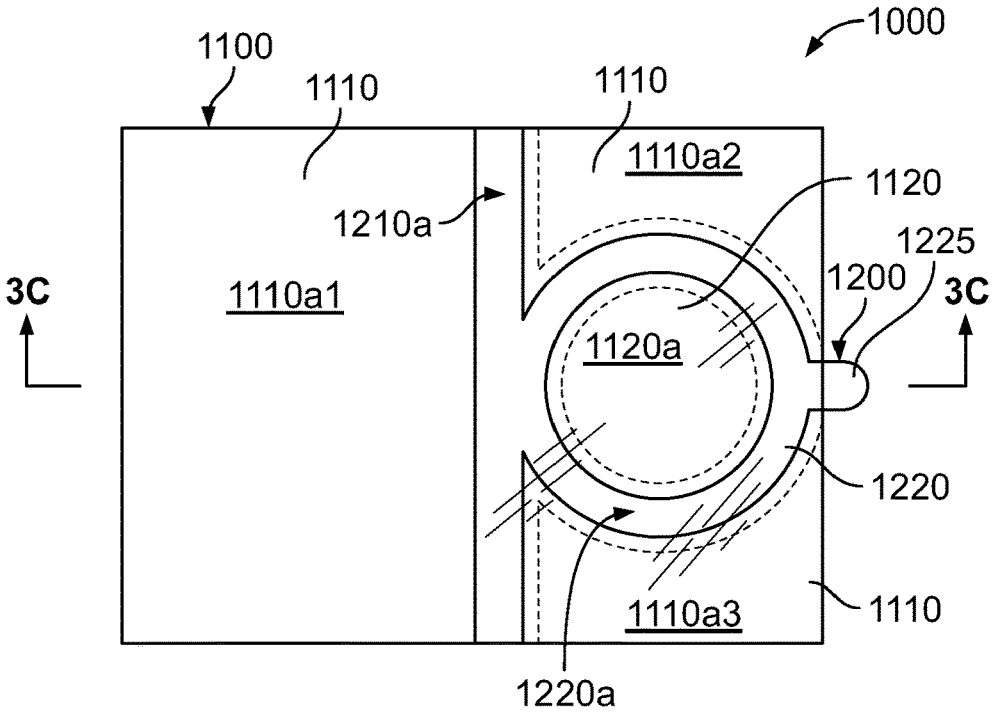
FIG. 3A is a top plan view of another embodiment of the container closing apparatus of the present disclosure attached to a container and in a nonuse configuration.
Figure 3B:
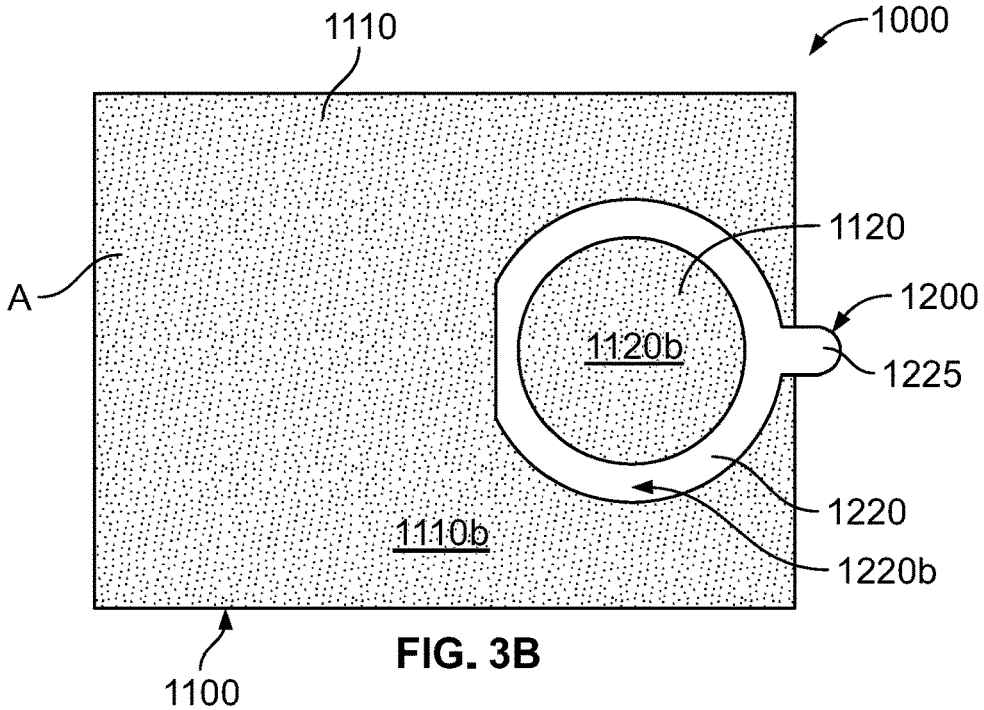
FIG. 3B is a bottom plan view of the container closing apparatus of FIG. 3A removed from the container.
Figure 3C:
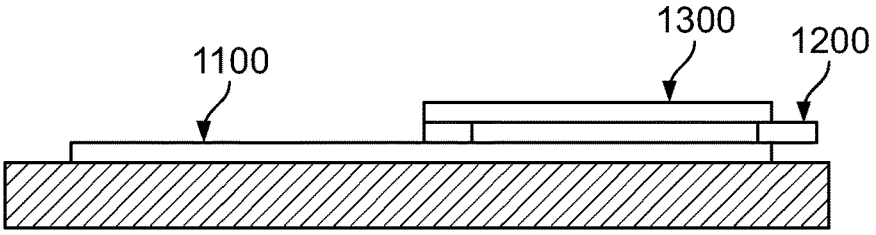
FIG. 3C is a side elevational view of the container closing apparatus of FIG. 3A.
Figure 3D:
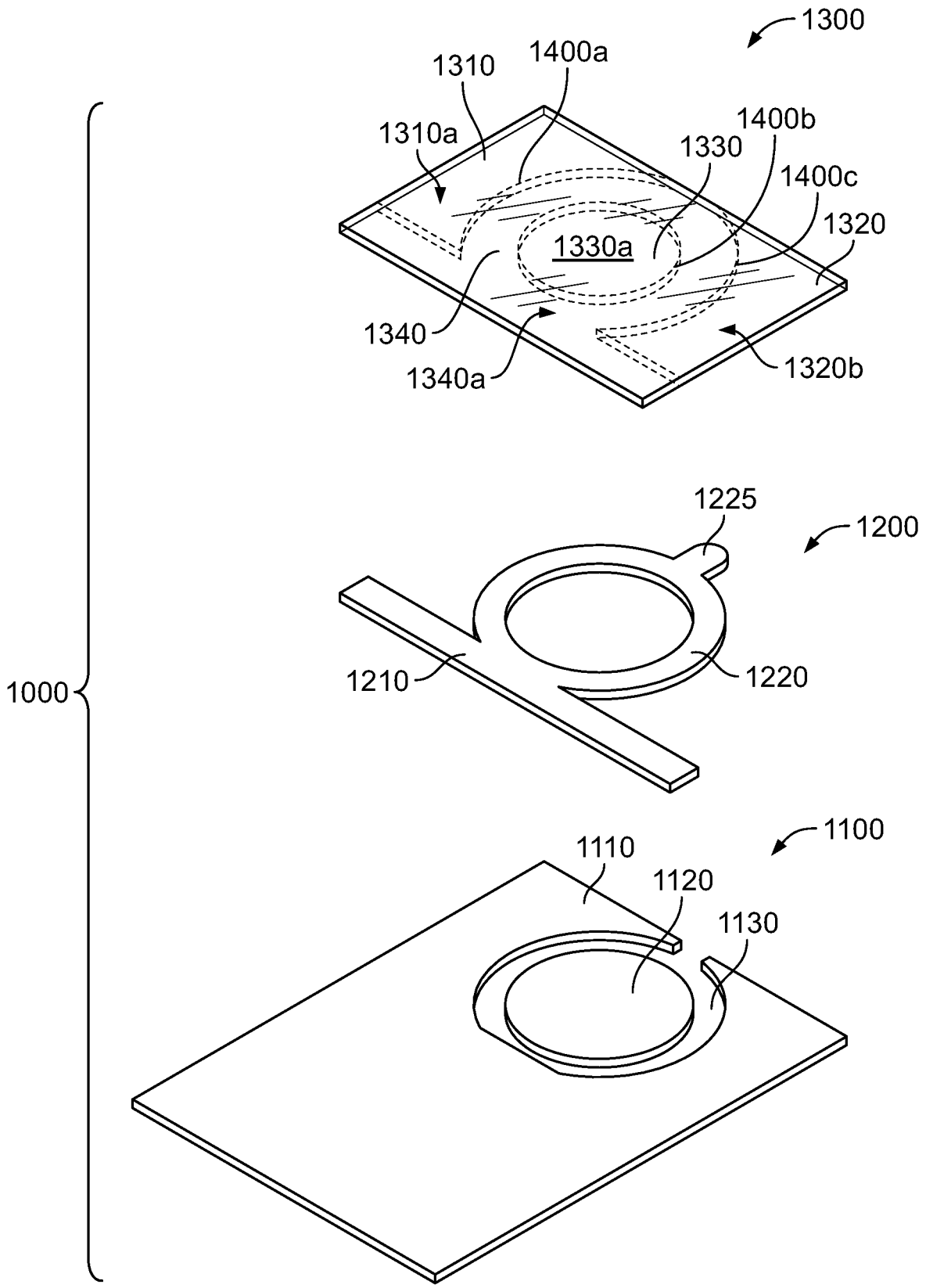
FIG. 3D is an exploded perspective view of the container closing apparatus of FIG. 3A.

As best shown in FIGS. 3A and 3D, the base 1100 includes a first base portion 1110 and a second base portion 1120. In this embodiment, an elastic member receiving opening 1130 extends around the second base portion 1120 and separates the first and second base portions 1110 and 1120. As best shown in FIGS. 3A and 3B, the first and second base portions 1110 and 1120 have respective upper surfaces 1110*a* (which includes portions 1110*a*1, 1110*a*2, and 1110*a*3) and 1120*a* and respective lower surfaces 1110*b* and 1120*b*. The portion 1110*a*1 of the upper surface 1110*a* may be opaque such that a coupon, and advertisement, or any other suitable text or graphic may be printed thereon. Alternatively or additionally, all or part of the portion 1110*a*1 may be left blank so the user can write on it (such as the date on which the user opened the container). In other embodiments, all or part of the portion 1110*a*1 may be transparent to enable the user to view text or graphics printed on the container.

As best shown in FIGS. 3A and 3D, the elastic member 1200 includes an attached elastic member portion 1210 and a detachable elastic member portion 1220. The detachable elastic member portion 1220 includes a grip portion 1225. The attached elastic member portion 1210 is attached to—and here integrally formed with—the detachable elastic member portion 1220. Similarly, the grip portion 1225 is attached to—and here integrally formed with, the detachable elastic member portion 1220. In other words, in this embodiment, the elastic member 1200 is unitary in that its components are integrally formed with one another.

The attached elastic member portion 1210 has a generally rectangular shape, though in other embodiments the attached elastic member portion may form any suitable shape. The detachable elastic member portion 1220 has a generally annular shape, though in other embodiments the detachable elastic member portion may have any suitable shape. The attached and detachable elastic member portions 1210 and 1220 have respective upper surfaces 1210*a* and 1220*a* and respective lower surfaces 1210*b* and 1220*b*.

As best shown in FIGS. 3A and 3D, the protective layer 1300 includes first, second, and third attached portions 1310, 1320, and 1330, respectively, and a detachable portion 1340. The first attached portion 1310, the second attached portion 1320, the third attached portion 1330, and the detachable portion 1340 have respective upper surfaces 1310*a*, 1320*a*, 1330*a*, and 1340*a* and respective lower surfaces 1310*b*, 1320*b*, 1330*b*, and 1340*b* (these are numbered for ease of reference but not shown). The protective layer 1300 is formed from a single piece of material. Perforations 1400*a*,

1400*b*, and 1400*c* defined through the protective layer 1300 define the above-listed portions and enable the detachable portion 1340 to be permanently detached from the attached portions 1310, 1320, and 1330, as described in detail below. In other words, the detachable portion 1340 is initially removably attached to the attached portions 1310, 1320, and 1330. The perforations 1400*a*, 1400*b*, and 1400*c* may be any suitable type (or types) of perforation(s).

The attached elastic member portion 1210 is directly attached to the first base portion 1110 of the base 1100 via adhesive (not shown) disposed between the lower surface 1210*b* of the attached elastic member portion 1210 and part of the upper surface 1110*a* of the first base portion 1110 of the base 1100. In this embodiment, the detachable elastic member portion 1220 is not directly attached to the base 1100, but is instead indirectly attached to the base 1100 via the attachment of the detachable elastic member portion 1220 to the attached elastic member portion 1210. As best shown in FIGS. 3A and 3B, the attached elastic member portion 1210 is attached to the first base portion 1110 such that the detachable elastic member portion 1220 is at least partially received in the elastic member receiving opening 1130 of the base 1100 and the free end of the grip portion 1225 extends outside of a perimeter of the base 1100.

The protective layer 1300 is directly attached to part of the base 1100 and to part of the elastic member 1200 via releasable adhesive (not shown) disposed between the lower surfaces 1310*b*, 1320*b*, 1330*b*, and 1340*b* of the portions 1310, 1320, 1330, and 1340 of the protective layer 1300 and (1) the upper surfaces 1110*a*2 and 1110*a*3 of the first portion 1110 of the base 1100; (2) the upper surface 1120*a* of the second portion 1120 of the base 1100; (3) the upper surface 1210*a* of the attached elastic member portion 1210 of the elastic member 1200; and (4) part of the upper surface 1220*a* of the detachable portion 1220 of the elastic member 1200. The protective layer 1300 is positioned relative to the base 1100 and the elastic member 1200 such that the detachable portion 1220 of the elastic member 1200 is disposed between the perforations 1400*a* and 1400*b* and the perforations 1400*b* and 1400*c*. As described below, this enables the detachable portion 1340 of the protective layer 1300 to be detached from the attached portions 1310, 1320, and 1330 of the protective layer 1300 via pulling the grip portion 1225 of the elastic member 1200 to transition the container closing apparatus 1000 from the nonuse configuration to the use configuration.

When the container closing apparatus 1000 is in the nonuse configuration: (1) the detachable portion 1340 of the protective layer 1300 is removably attached to the attached portions 1310, 1320, and 1330 of the protective layer 1300 via the perforations 1400*a*, 1400*b*, and 1400*c*; (2) the protective layer 1300 is directly attached to part of the base 1100 and to part of the elastic member 1200 as described above; and (3) the detachable portion 1220 of the elastic member 1200 is at least partially received in the elastic member receiving opening 1130 of the base 1100.

When the container closing apparatus 1000 is in the use configuration: (1) the detachable portion 1340 of the protective layer 1300 is permanently detached from the attached portions 1310, 1320, and 1330 of the protective layer 1300 and removed from the elastic member 1200; (2) the attached portions 1310, 1320, and 1330 of the protective layer are directly attached to the base 1100; and (3) the detachable portion 1220 of the elastic member 1200 is removed from the elastic member receiving opening 1130 of the base 1100. That is, when the container closing apparatus 1000 is in the use configuration in this embodiment, the detachable portion 1220 of the elastic member 1200 is free to move relative to the base 1100 and the remaining attached portions 1310, 1320, and 1330 of the protective layer 1300 attached to the base 1100. Once the container closing apparatus 1000 has transitioned from the nonuse configuration to the use configuration, the container closing apparatus 1000 cannot transition back to the nonuse configuration. In other words, the transition is permanent in this embodiment.

As best shown in FIG. 3B, the container closing apparatus 1000 is directly attached to the container C via an adhesive A disposed between the lower surface of the base 1100 and the container C. More specifically, the adhesive A is disposed between the container C and the lower surfaces 1110*b* and 1120*b* of the first and second portions 1110 and 1120 of the base 1100. In this embodiment, the adhesive A is not disposed between the lower surface 1120*b* of the detachable portion 1220 of the elastic member 1200 and the container C.

The drawings are not to scale, and the thickness of the base, the elastic member, and the protective layer are exaggerated for clarity.

FIGS. 4A-4D illustrate one example embodiment of a user transitioning the container closing apparatus 1000 from the nonuse configuration to the use configuration and using the container closing apparatus 1000 to secure the container C closed.

Figure 4B:
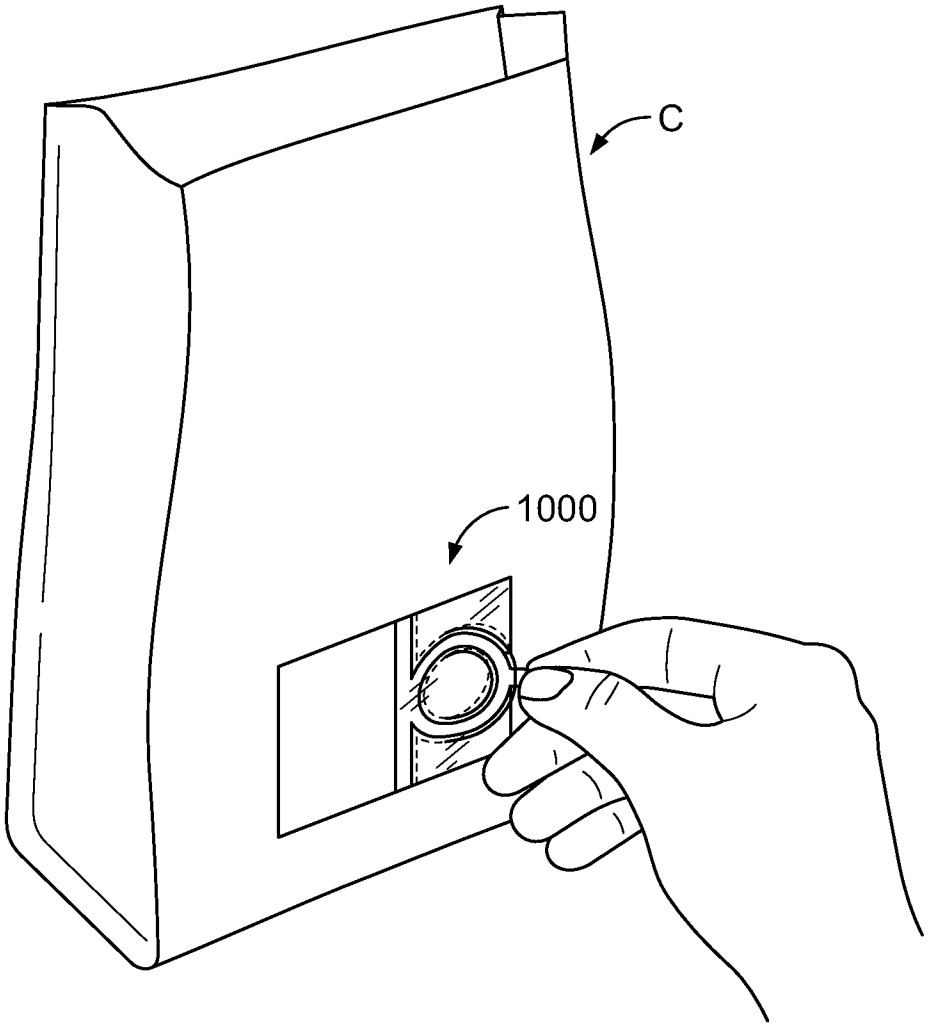
FIG. 4B is a perspective view of the container of FIG. 4A after the user has partially removed the detachable portion of the elastic member of the container closing apparatus from the elastic member receiving channel of the base of the container closing apparatus to begin transitioning the container closing apparatus from the nonuse configuration to the use configuration.
Figure 4A:
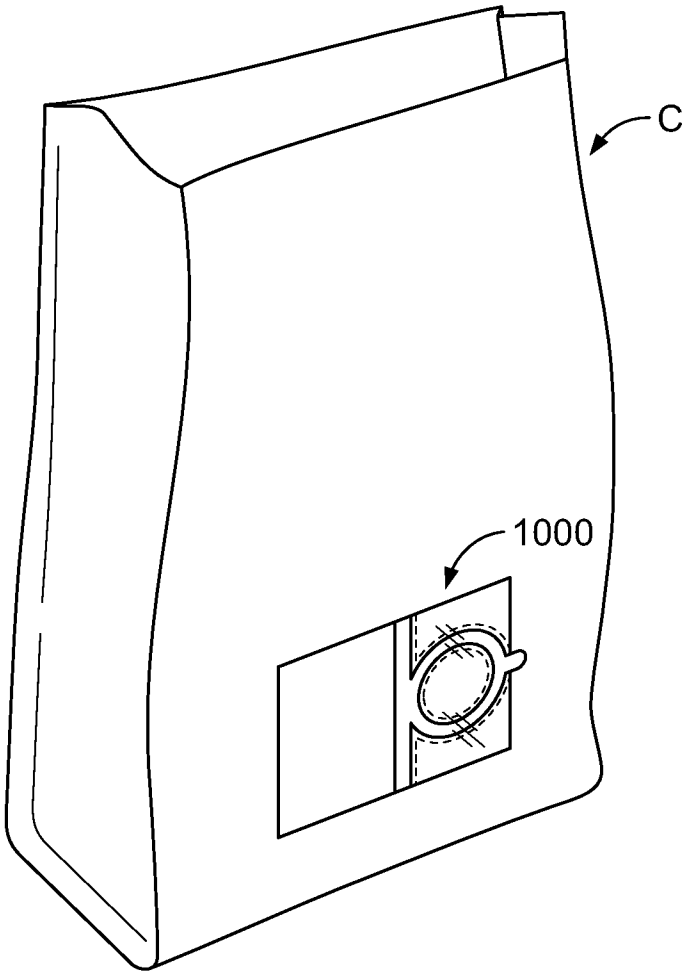
FIG. 4A is a perspective view of a deformable container that has an open upper end and a sealed lower end and to which the container closing apparatus of FIG. 3A is attached. The container closing apparatus is in the nonuse configuration.

As shown in FIG. 4A, the container C's upper end is open, and the container closing apparatus 1000 is initially in the nonuse configuration (described above).

To begin transitioning the container closing apparatus 1000 from the nonuse configuration to the use configuration, a user grips the grip portion 1225 of the detachable portion 1220 of the elastic member 1200 and imposes a pulling force on the grip portion 1225 in a direction away from the base 1100. This pulling force (if large enough) causes the detachable portion 1220 of the elastic member 1200 to begin exiting the elastic member receiving opening 1130 of the base 1100. This causes the detachable portion 1340 of the protective layer 1300—which is directly attached to part of the detachable portion 1220 of the elastic member 1200—to begin detaching from the first and second attached portions 1310 and 1320 of the protective layer 1300 along perforations 1400*a* and 1400*c*. As the user continues to apply the pulling force on the grip portion 1225, the detachable portion 1220 of the elastic member 1200 continues exiting the elastic member receiving opening 1130 of the base 1100, which causes the detachable portion 1340 of the protective layer 1300 to begin detaching from the third attached portion 1330 of the protective layer 1300 along the perforation 1400*b*. FIG. 4B shows the container closing apparatus 1000 after the user has partially removed the detachable portion 1220 of the elastic member 1200 from the elastic member receiving opening 1130 of the base 1100, thereby partially detaching the detachable portion 1340 of the protective layer 1300 from the attached portions 1310, 1320, and 1330 of the protective layer 1300.

Figure 4D:
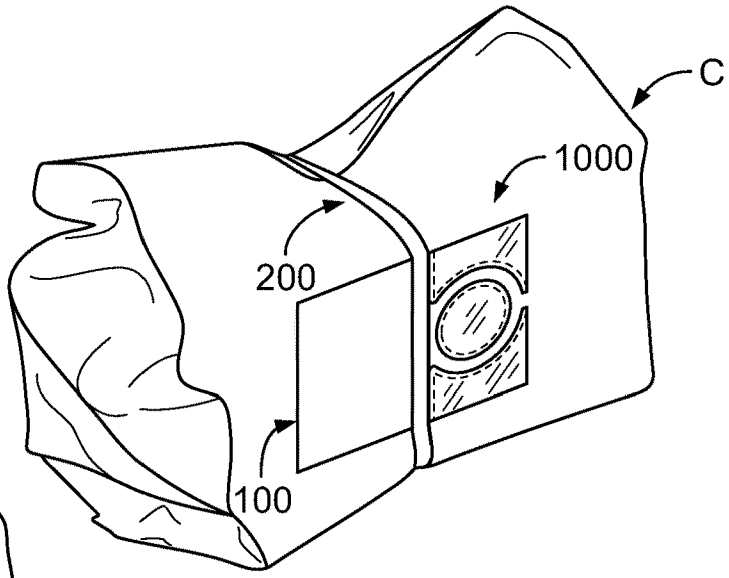
FIG. 4D is a perspective view of the container of FIG. 4A after the user has deformed the container and secured it closed by circumscribing the container with the detachable portion of the elastic member of the container closing apparatus (which is in the use configuration).
Figure 4C:
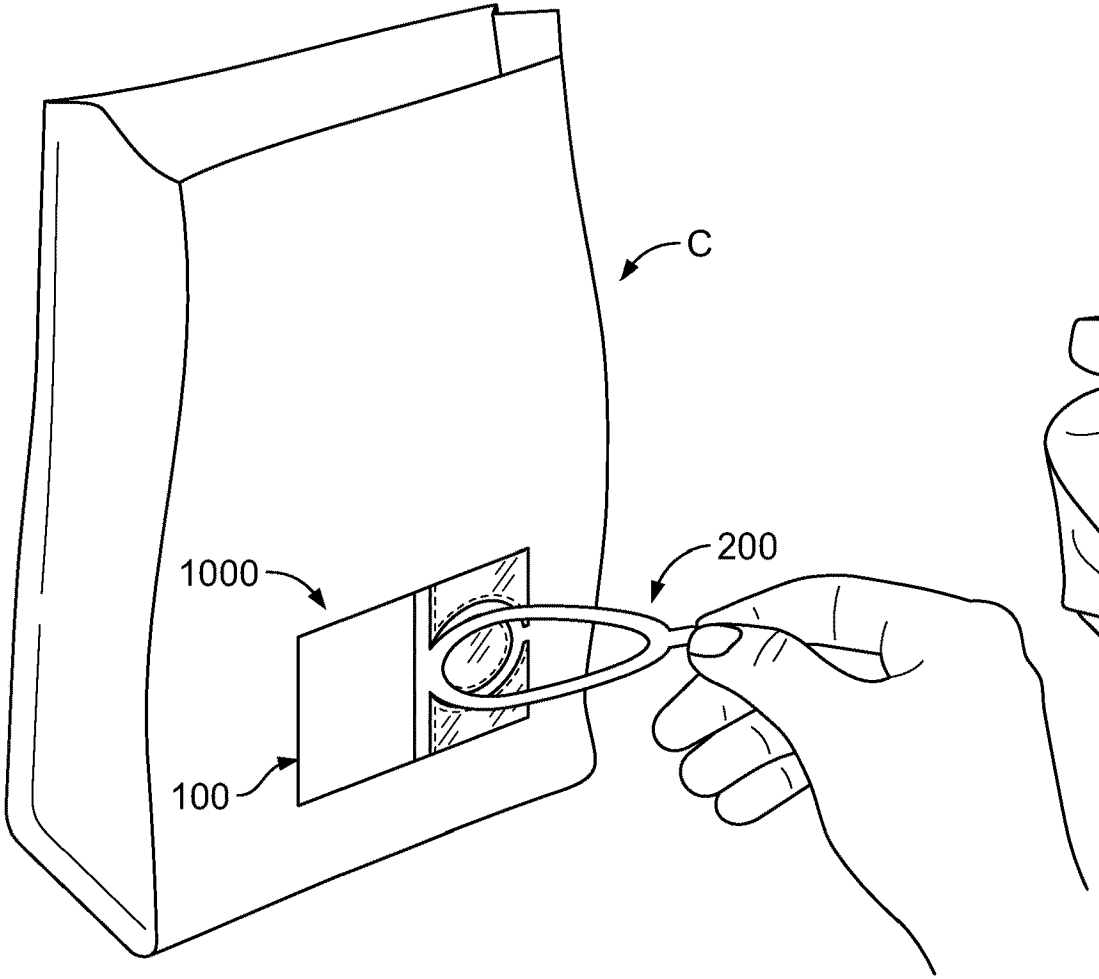
FIG. 4C is a perspective view of the container of FIG. 4A after the user has completely removed the detachable portion of the elastic member of the container closing apparatus from the elastic member receiving channel of the base of the container closing apparatus such that the container closing apparatus is in the use configuration.

The user ceases to apply the pulling force on the grip portion 1225 once the detachable portion 1220 of the elastic member 1200 has exited the elastic member receiving opening 1130 of the base 1100. At this point, the detachable portion 1340 of the protective cover 1300 has completely detached from the third attached portion 1330 of the base 1100 along the perforation 1400*b* and has partially detached from the first and second attached portions 1310 and 1320 of the protective cover 1300 along the perforations 1400*a* and 1400*c*, respectively. The user then grips the detachable portion 1340 of the protective cover 1300 and pulls it to finish detaching it from the first and second attached portions 1310 and 1320 of the protective cover 1300 along the perforations 1400*a* and 1400*c* and from the elastic member 1200. The user discards the detachable portion 1340. As shown in FIG. 4C, the elastic member 1200 has a normal shape—here, an annular shape (though it may have any suitable shape as indicated above). The properties of the elastic material from which the elastic member 1200 is made render the detachable portion 1220 of the elastic member 1200 deformable (e.g., flexible and stretchable) yet biased to return to its normal shape.

When the user desires to close the container C, the user pinches the open end closed and rolls the open end toward the sealed lower end to force much of the air out of the container C. Afterwards, the user stretches the detachable portion 1220 of the elastic member 1200 radially outward and circumscribes the container C with the detachable portion 1220 of the elastic member 1200. The user then releases the detachable portion 1220 of the elastic member 1200. Since the detachable portion 1220 of the elastic member 1200 is stretched at the point in time at which the user releases the detachable portion 1220 of the elastic member 1200, the detachable portion 1220 of the elastic member 1200 attempts to return to its normal shape. In doing so, the detachable portion 1220 of the elastic member 1200 contracts radially inward until it contacts the container C and applies a compressive force to the container C along the circumference of the detachable portion 1220 of the elastic member 1200. FIG. 4D shows the container C secured closed via the loop of the container closing apparatus.

Figure 5:
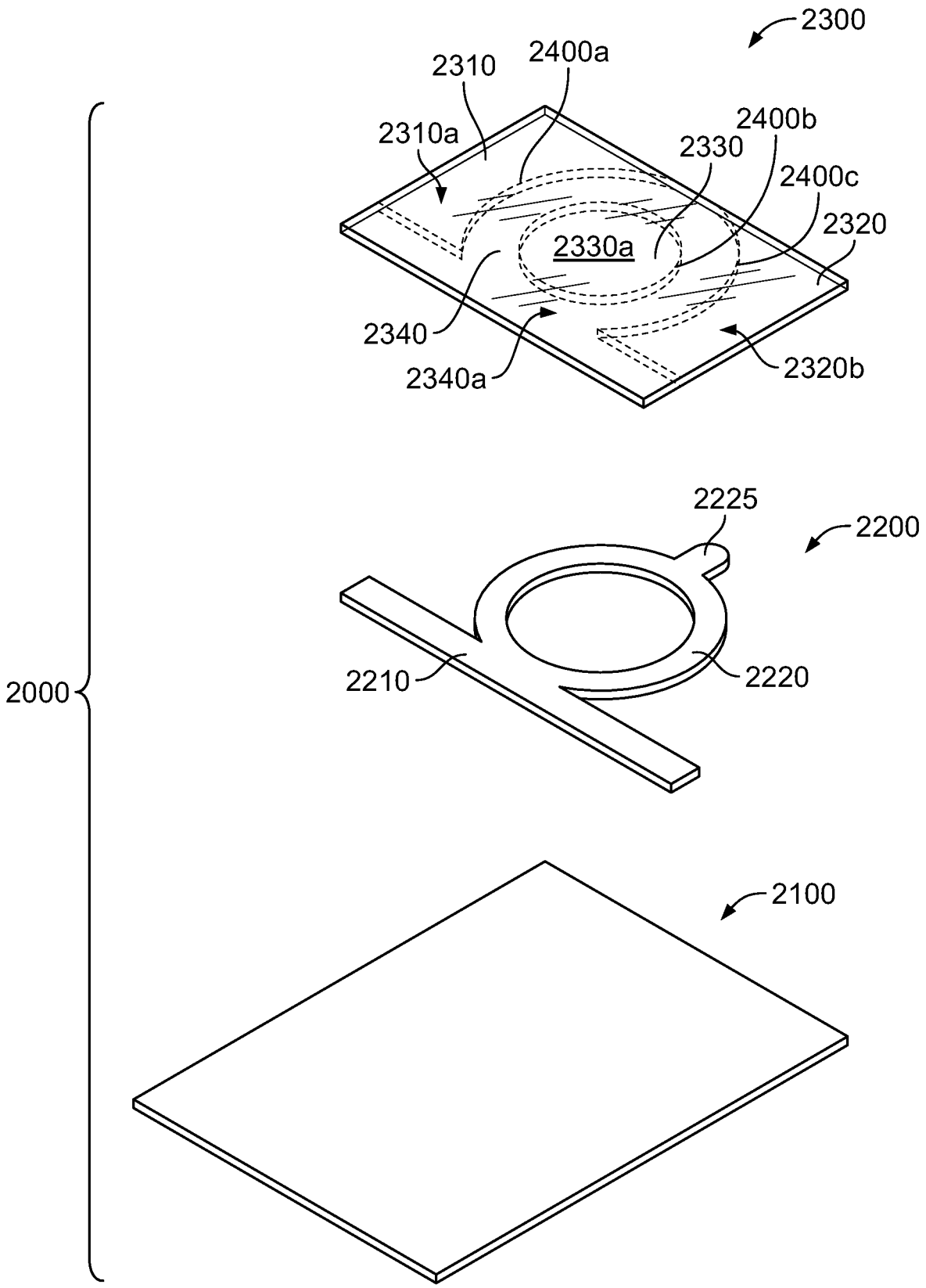
FIG. 5 is an exploded perspective view of another embodiment of the container closing apparatus of the present disclosure.

FIG. 5 illustrates another embodiment of the container closing apparatus 2000. This embodiment is similar to the embodiment shown in FIGS. 3A-4D except the base 2100 does not define an elastic member receiving opening therethrough. In this embodiment, the detachable portion 2220 of the elastic member 2200 is not directly attached to the base 2100, but is indirectly attached to the base 2100 via the protective layer 2300. In another embodiment the detachable portion 2220 of the elastic member 1200 is directly and removably attached to the base 2100 via a suitable releasable adhesive.

Figure 6:
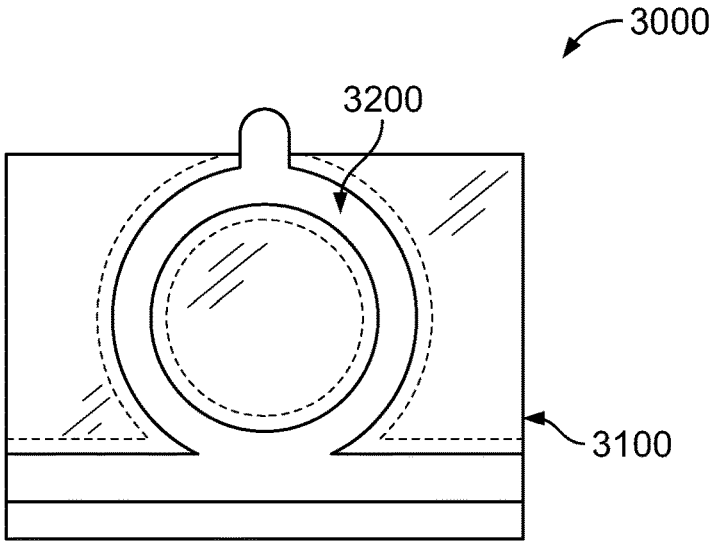
FIG. 6 is a top plan view of another embodiment of the container closing apparatus of the present disclosure in a nonuse configuration.

FIG. 6 illustrates another embodiment of the container closing apparatus 3000 that is similar to the container closing apparatus 1000, but includes a differently shaped base 3100.

Figure 7:
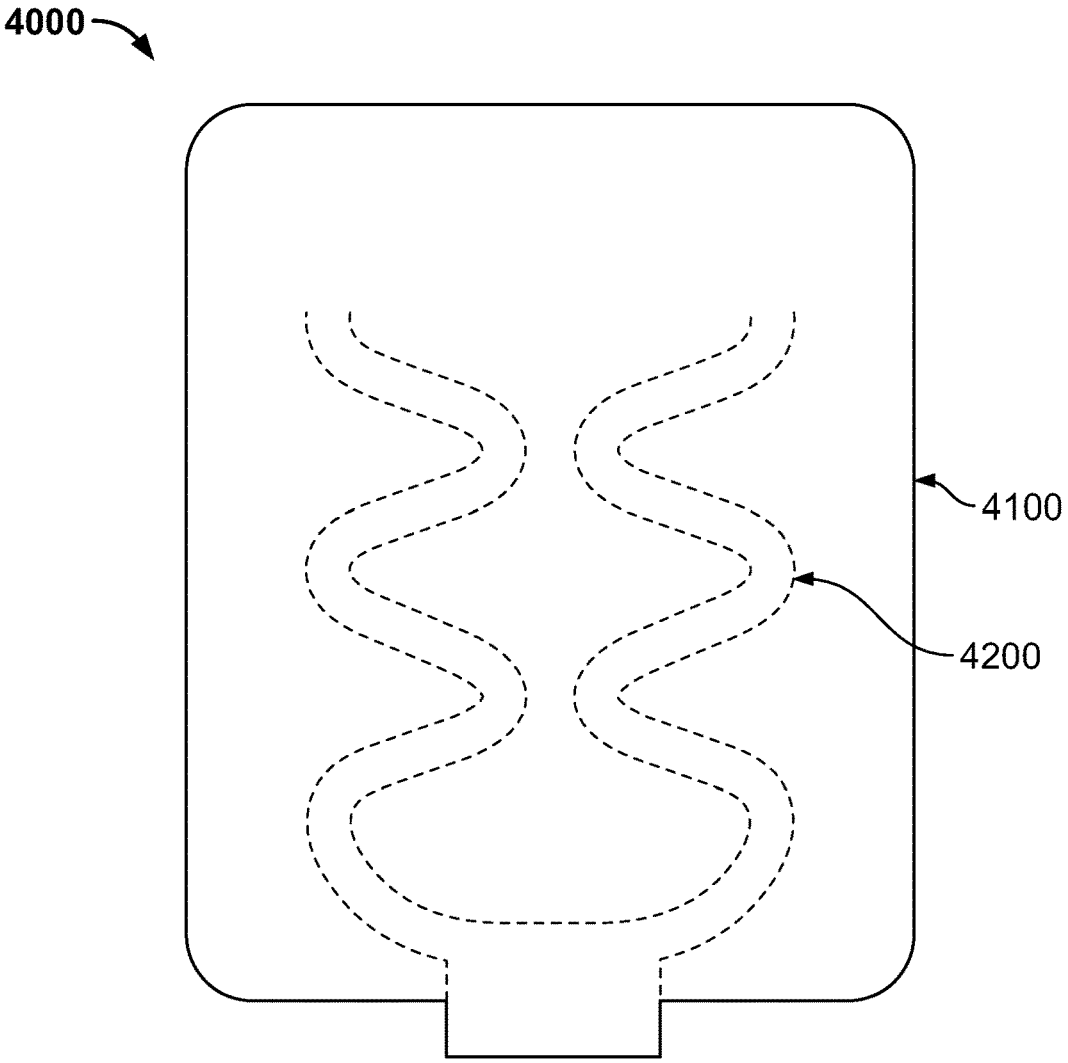
FIG. 7 is a top plan view of another embodiment of the container closing apparatus of the present disclosure in a nonuse configuration.

FIG. 7 illustrates another embodiment of the container closing apparatus 4000 that is similar to the container closing apparatus 10, but includes a differently shaped elastic member 4200.

In certain embodiments, the entire elastic member is detachable from the base. For instance, in certain such embodiments, the entirely of the outer and inner perimeters of the elastic member are removably attached to the base via perforations. In these embodiments, to transition the container closing apparatus from the nonuse configuration to the use configuration, a user completely detaches the entire elastic member from the base. The user then uses the elastic member to circumscribe the container in a manner similar to that described above.

FIGS. 8A-8D illustrate one such example embodiment of the container closing apparatus 5000 including a base 5100 and an elastic member 5200 that is removably attached to the base 5100 via perforations (not labeled) such that the entire elastic member 5200 is detachable from the base 5100 via the perforations. FIGS. 8A-8D also illustrate a user transitioning the container closing apparatus 5000 from a nonuse configuration to a use configuration and using the container closing apparatus 5000 to secure the container C closed.

Figure 8B:
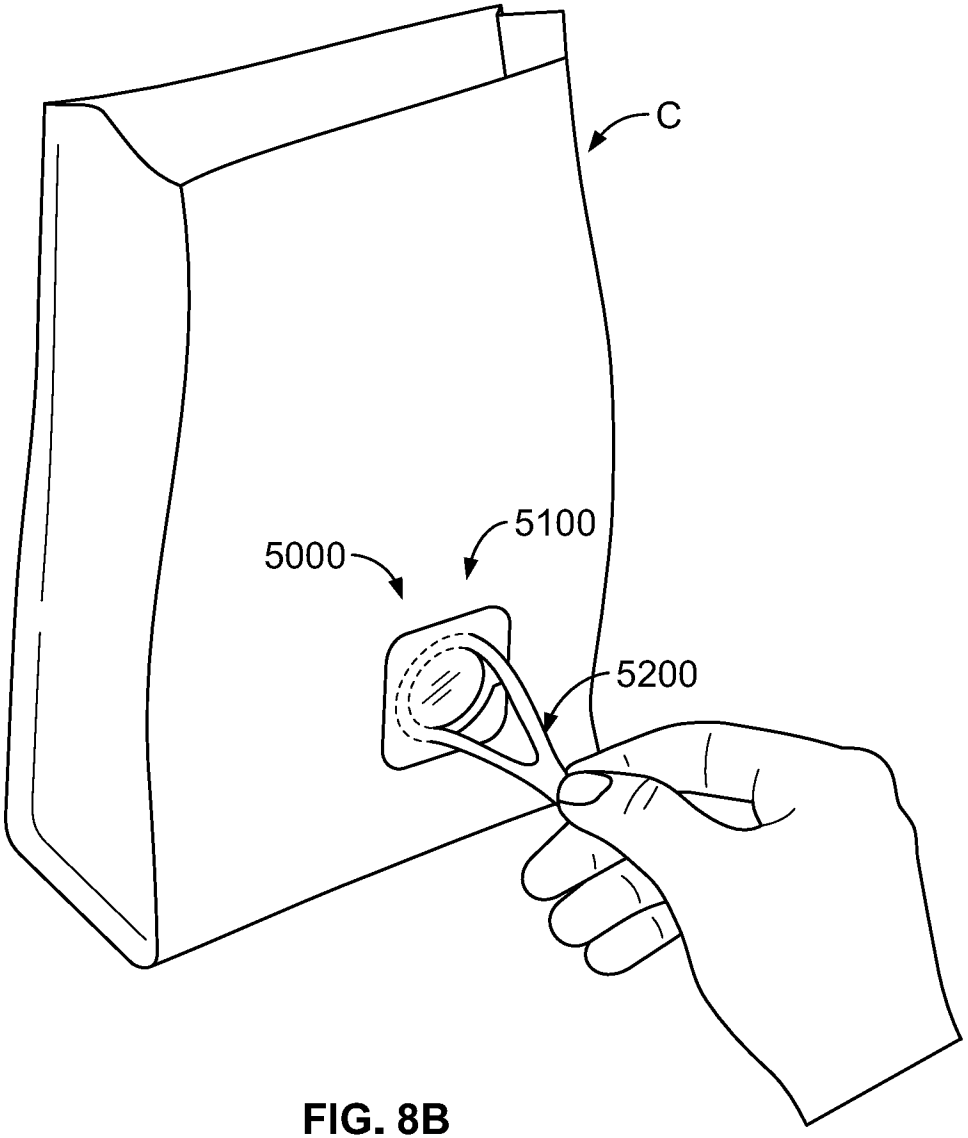
FIG. 8B is a perspective view of the container of FIG. 8A after the user has partially detached the elastic member of the container closing apparatus from the base of the container closing apparatus to begin transitioning the container closing apparatus from the nonuse configuration to the use configuration.
Figure 8A:
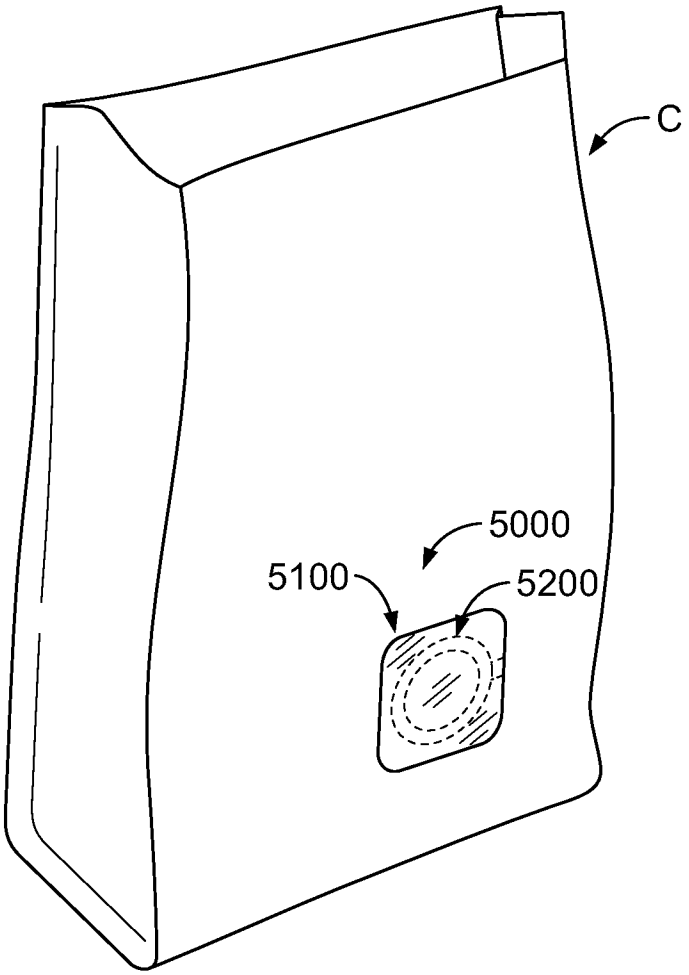
FIG. 8A is a perspective view of a deformable container that has an open upper end and a sealed lower end and to which another embodiment of the container closing apparatus of the present disclosure is attached. The container closing apparatus is in the nonuse configuration.
Figure 8D:
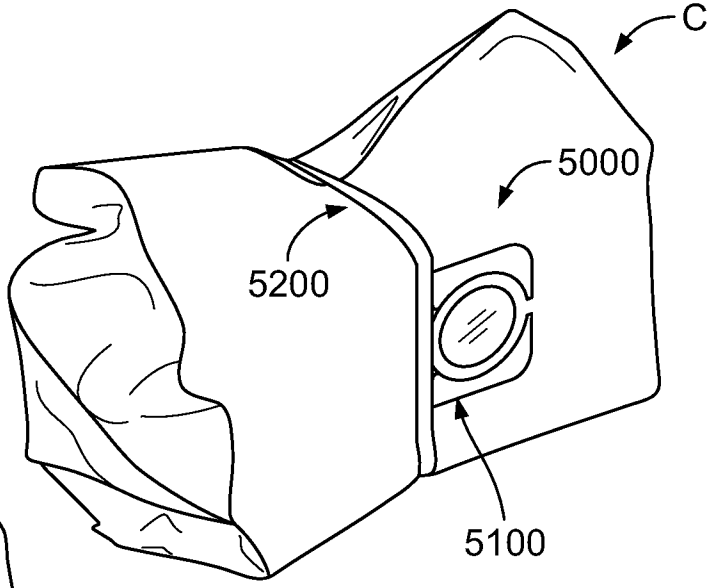
FIG. 8D is a perspective view of the container of FIG. 8A after the user has deformed the container and secured it closed by circumscribing the container with the elastic member of the container closing apparatus (which is in the use configuration).
Figure 8C:
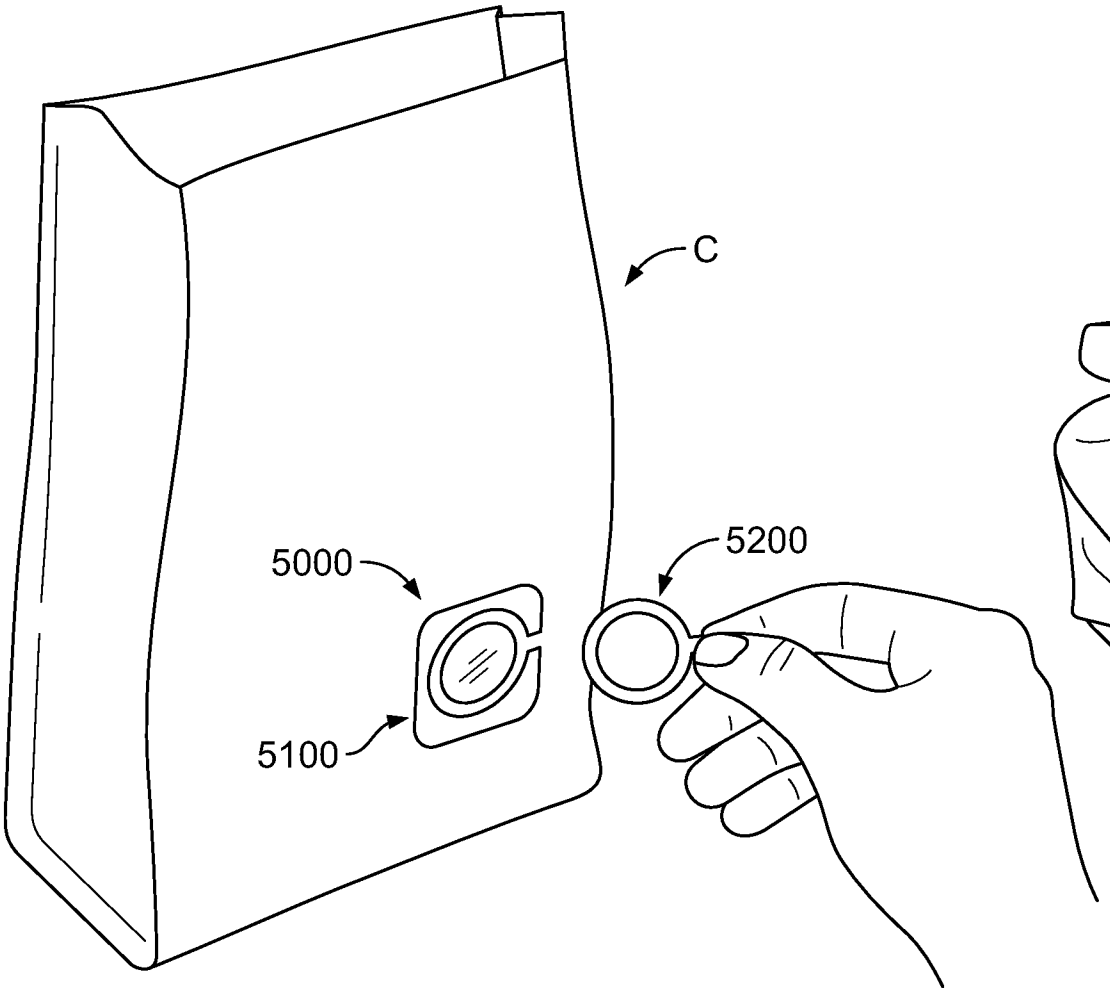
FIG. 8C is a perspective view of the container of FIG. 8A after the user has completely detached the elastic member of the container closing apparatus from the base of the container closing apparatus such that the container closing apparatus is in the use configuration.

As shown in FIG. 8A, the container C's upper end is open, and the container closing apparatus 5000 is initially in the nonuse configuration (in which the elastic member 5200 is attached to the base 5100). To begin transitioning the container closing apparatus 5000 from the nonuse configuration to the use configuration, a user grips a grip portion (not labeled) of the elastic member 5200 and imposes a pulling force on the grip portion in a direction away from the base 5100. Assuming the user applies a large enough pulling force on the grip portion, the grip portion detaches from the base 5100 via the perforations. As the user continues to apply the pulling force on the grip portion, the elastic member 5200 continues to detach from the base 5100 via the perforations. FIG. 8B shows the container closing apparatus 5000 after the user has partially detached the elastic member 5200 from the base 5100 to begin transitioning the container closing apparatus 5000 from the nonuse configuration to the use configuration. Continued application of the pulling force causes the elastic member 5200 to completely detach from the base 5100, as shown in FIG. 8C.

When the user desires to close the container C, the user pinches the open end closed and rolls the open end toward the sealed lower end to force much of the air out of the container C. Afterwards, the user stretches the elastic member 5200 radially outward and circumscribes the container C with the loop formed by the elastic member 5200. The user then releases the elastic member 5200. Since the elastic member 5200 is stretched at the point in time at which the user releases the elastic member 5200, the elastic member 5200 attempts to return to its normal shape. In doing so, the elastic member 5200 contracts radially inward until it contacts the container C and applies a compressive force to the container C along the circumference of the loop. FIG. 8D shows the container C secured closed via the loop of the container closing apparatus.

Figure 9A:
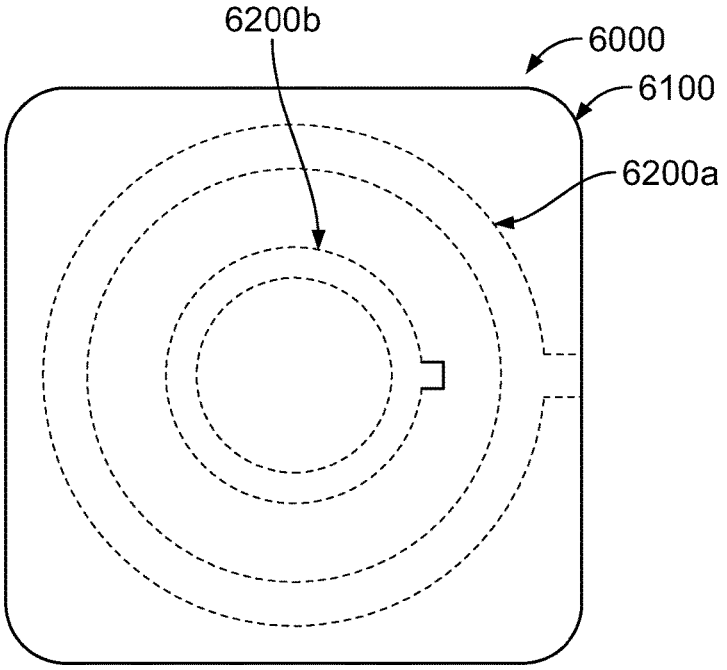
FIG. 9A is a top plan view of another embodiment of the container closing apparatus of the present disclosure with multiple elastic members removably attached to the base.
Figure 9B:
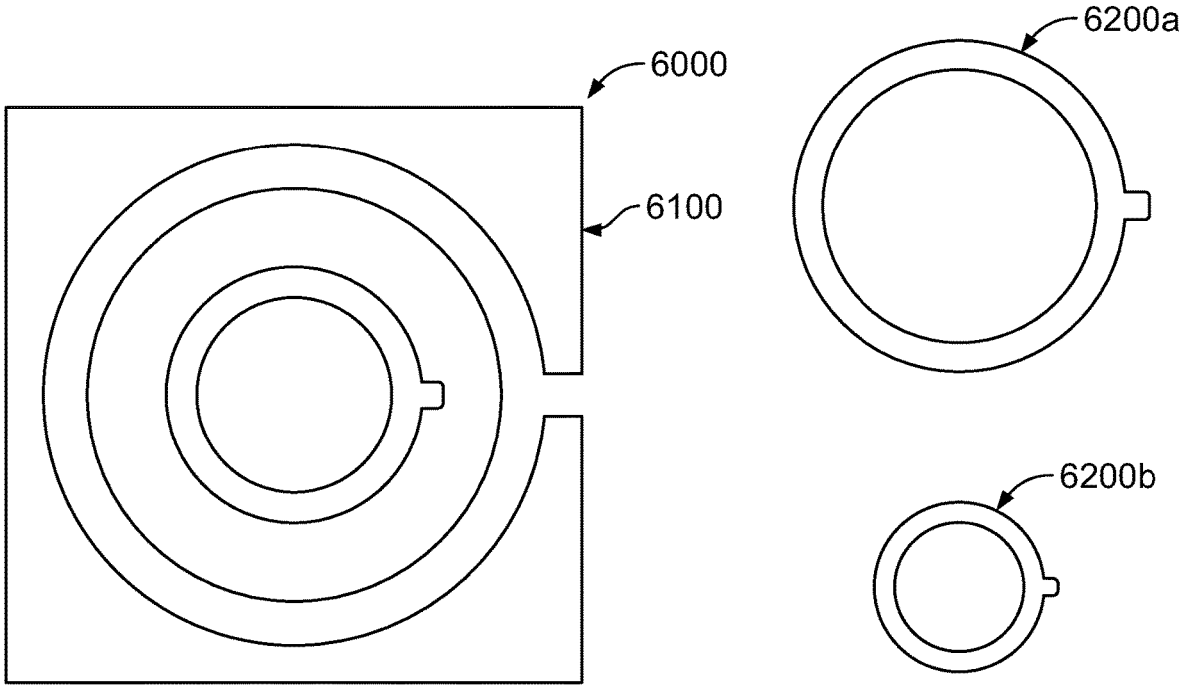
FIG. 9B is a top plan view of the container closing apparatus of FIG. 9A after the elastic members have been detached from the base.

In certain embodiments, the container closing apparatus includes multiple elastic members removably attached to the base. For instance, in certain such embodiments, the container closing apparatus includes multiple elastic members having different sizes (such as different radii) usable for different levels of fill of the container. For example, a larger elastic member is usable to secure the container closed when the container is generally full, while a smaller elastic member is usable to secure the container closed when the container is less full. FIGS. 9A and 9B illustrate one such example embodiment of the container closing apparatus 6000 including a base 6100 and first and second elastic members 6200*a* and 6200*b* that are removably attached to the base 6100 perforations (not labeled) such that each elastic member 6200*a* and 6200*b* is independently detachable from the base 6100 via the perforations.

While the container is a bag in the embodiments described above and shown in the accompanying figures, the container may be any suitable type of container. FIGS. 10A-10E show another embodiment of the container closing apparatus 7000 attached to a container that is a susceptor S. The container closing apparatus 7000 is identical to the container closing apparatus 5000 (described above), and includes a base 7100 and an elastic member 7200 removably attached to the base 7100.

The susceptor S is sized, shaped, and otherwise configured to receive a food product F (such as a sandwich or a pastry) and to provide crisping and browning to the outer surface of the food product F during cooking in a microwave oven. More specifically, the susceptor S includes a metallic layer (not shown) configured to absorb microwave radiation during cooking in the microwave oven and convert that absorbed radiation into heat. The portion of the susceptor S that contacts the outer surface of the food product F during cooking in the microwave oven transfers that heat to the outer surface, which causes the outer surface to brown and crisp. The more of the outer surface of the food product F that the susceptor S contacts, the more even the browning and crisping of the outer surface.

Figure 10B:
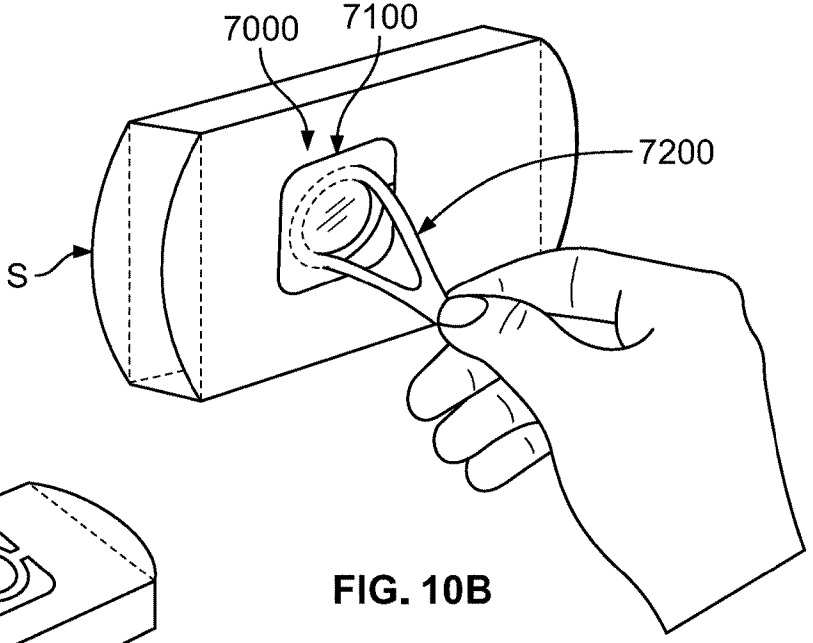
FIG. 10B is a perspective view of the susceptor of FIG. 10A after the user has partially detached the elastic member of the container closing apparatus from the base of the container closing apparatus to begin transitioning the container closing apparatus from the nonuse configuration to the use configuration.
Figure 10A:
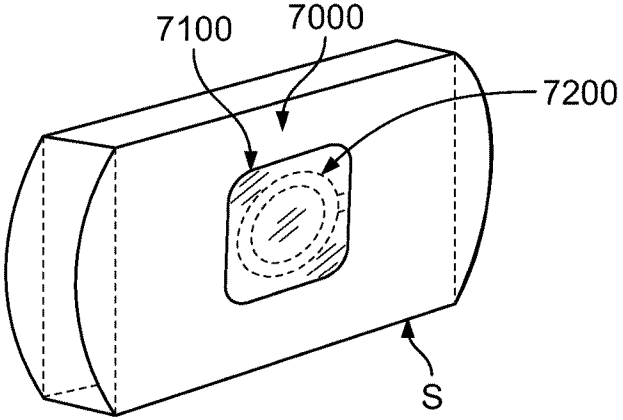
FIG. 10A is a perspective view of a susceptor to which another embodiment of the container closing apparatus of the present disclosure is attached. The container closing apparatus is in the nonuse configuration.
Figure 10C:
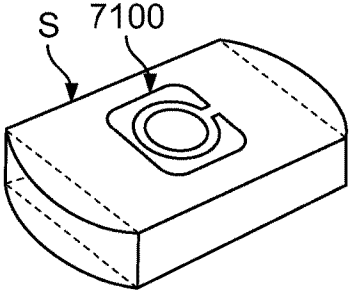
FIG. 10C is a perspective view of the susceptor of FIG. 10A after the user has completely detached the elastic member of the container closing apparatus from the base of the container closing apparatus such that the container closing apparatus is in the use configuration.

In this example embodiment, a user uses the container closing apparatus 7000 to ensure good contact between the susceptor S and the food product F. First, as shown in FIG. 10B, the user grips a grip portion (not labeled) of the elastic member 7200 and imposes a pulling force on the grip portion in a direction away from the base 7100. Assuming the user applies a large enough pulling force on the grip portion, the grip portion detaches from the base 7100 via the perforations. As the user continues to apply the pulling force on the grip portion, the elastic member 7200 continues to detach from the base 7100 via the perforations.

Figure 10F:
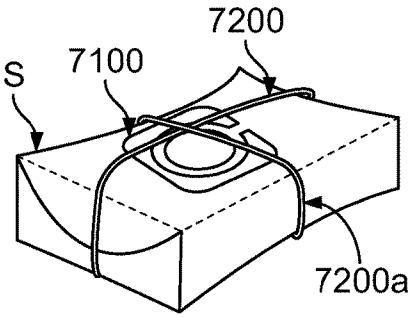
FIG. 10F is a perspective view of the susceptor of FIG. 10A after the user has circumscribed the susceptor with the elastic member of the container closing apparatus (which is in the use configuration).
Figure 10E:
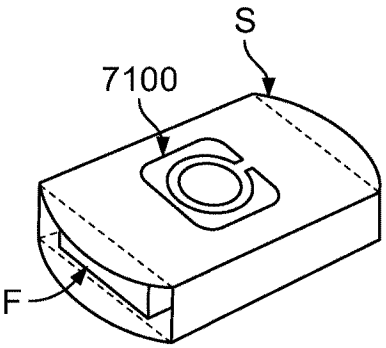
FIG. 10E is a perspective view of the susceptor of FIG. 10A after receiving the food product of FIG. 10D.
Figure 10D:
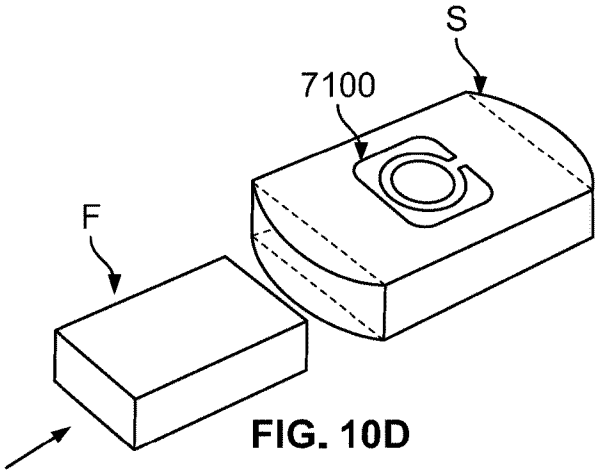
FIG. 10D is a perspective view of the susceptor of FIG. 10A and a food product sized to be received in the susceptor.

After the user has detached the elastic member 7200 from the base 7100, the user inserts the food product F into the susceptor S and manipulates the susceptor S to enclose the food product F, as shown in FIGS. 10C-10F. To ensure good contact between the interior surface of the susceptor S and the outer surface of the food product F, the user stretches the elastic member 7200 radially outward and circumscribes the susceptor S with the loop formed by the elastic member 7200. The user then releases the elastic member 7200. Since the elastic member 7200 is stretched at the point in time at which the user releases the elastic member 7200, the elastic member 7200 attempts to return to its normal shape. In doing so, the elastic member 7200 contracts radially inward until it contacts the susceptor S and applies a compressive force to the susceptor S along the circumference of the loop. This compressive force causes the susceptor S to deform such that the susceptor S conforms to and contacts the outer surface of the food product F to provide even browning and crisping during cooking in a microwave oven. FIG. 10F shows a second elastic member 7200*a* that circumscribes the susceptor S, though any suitable quantity of elastic members may be employed.

While the features, methods, devices, and systems described herein may be embodied in various forms, the drawings show and this patent application describes some exemplary and non-limiting embodiments. Not all of the depicted components described in this patent application may be required, and some implementations may include additional, different, or fewer components from those described. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. An apparatus for securing a container closed, the apparatus comprising:

a base;

an elastic member comprising an attached portion attached to the base and a detachable portion removably attached to the base; and a protective layer attached to the base and to the detachable portion of the elastic member, wherein the detachable portion of the elastic member is indirectly removably attached to the base via the protective layer, wherein the apparatus is transitionable to a use configuration in which the detachable portion of the elastic member is detached from the base and the attached portion of the elastic member is attached to the base such that the elastic member at least partially forms an at least partially deformable loop.

2. The apparatus of claim 1, wherein the detachable portion of the elastic member is removably attached to the base along a perforation.

3. The apparatus of claim 1, further comprising a perimeter surface.

4. The apparatus of claim 3, wherein a portion of the detachable portion of the elastic member comprises part of the perimeter surface.

5. The apparatus of claim 4, wherein the remainder of the detachable portion of the elastic member is offset inward from the perimeter surface so no other portion of the elastic member comprises part of the perimeter surface.

6. The apparatus of claim 1, wherein the elastic member is integrally formed with the base.

7. The apparatus of claim 1, wherein the elastic member is separate from the base.

8. The apparatus of claim 1, wherein the elastic member comprises a first elastic member portion attached to a second elastic member portion.

9. The apparatus of claim 8, wherein the first elastic member portion is attached to the second elastic member portion via a grip portion that separates the first and second elastic member portions.

10. The apparatus of claim 9, further comprising a perimeter surface, wherein the grip portion forms part of the perimeter surface.

11. The apparatus of claim 10, wherein neither the first nor the second elastic member portion forms part of the perimeter surface.

12. The apparatus of claim 1, wherein the apparatus is not transitionable from the use configuration to the nonuse configuration.

13. A container comprising:

an end;

a side connected to the end; and a container closing apparatus attached to one of the end and the side, the container closing apparatus comprising:

a base;

an elastic member comprising an attached portion attached to the base and a detachable portion removably attached to the base; and a protective layer attached to the base and to the detachable portion of the elastic member, wherein the detachable portion of the elastic member is indirectly removably attached to the base via the protective layer, wherein the container closing apparatus is transitionable into a use configuration in which the detachable portion of the elastic member is detached from the base and the attached portion of the elastic member is attached to the base such that the elastic member at least partially forms an at least partially deformable loop.

14. The container of claim 13, wherein the detachable portion of the elastic member is removably attached to the base along a perforation.

15. The container of claim 13, wherein the container closing apparatus further comprises a perimeter surface, wherein a portion of the detachable portion of the elastic member comprises part of the perimeter surface.

16. The container of claim 15, wherein the remainder of the detachable portion of the elastic member is offset inward from the perimeter surface so no other portion of the elastic member comprises part of the perimeter surface.

17. The container of claim 13, wherein the container closing apparatus is attached to the one of the end and the side via an adhesive disposed on a surface of the base, wherein the adhesive is not disposed on the detachable portion of the elastic member.

18. The container of claim 13, wherein the side comprises a metallic layer configured to convert microwave radiation into heat.

19. The container of claim 13, wherein the container holds a product and the at least partially deformable loop of the elastic member circumscribes the container to enclose the product within the container.

20. The container of claim 19 wherein the product is selected from the group consisting of: food, hardware, seeds, bulk items, and combinations thereof.

* * * * *